US012352044B2

(12) United States Patent
Hammes et al.

(10) Patent No.: US 12,352,044 B2
(45) Date of Patent: Jul. 8, 2025

(54) MODULAR REATTACHABLE STRUCTURE SYSTEM AND METHOD

(71) Applicant: Planet Growth LLC, Racine, WI (US)

(72) Inventors: Conor Hammes, Racine, WI (US); Charles Strickler, New Castle, PA (US); Lee Edward Finley, Jr., Racine, WI (US)

(73) Assignee: Planet Growth LLC, Racine, WI (US)

( * ) Notice: Subject to any disclaimer, the term of this patent is extended or adjusted under 35 U.S.C. 154(b) by 16 days.

(21) Appl. No.: 18/482,489

(22) Filed: Oct. 6, 2023

(65) Prior Publication Data

US 2024/0102278 A1 Mar. 28, 2024

Related U.S. Application Data

(63) Continuation of application No. 18/135,820, filed on Apr. 18, 2023, now Pat. No. 11,939,766, which is a continuation of application No. 17/887,323, filed on Aug. 12, 2022, now Pat. No. 11,674,308.

(51) Int. Cl.
*E04B 2/74* (2006.01)

(52) U.S. Cl.
CPC .... *E04B 2/7457* (2013.01); *E04B 2002/7468* (2013.01)

(58) Field of Classification Search
CPC ..... E04B 2/7457; E04B 2002/7468; E04B 1/7675; E04B 1/3483
See application file for complete search history.

(56) References Cited

U.S. PATENT DOCUMENTS

| | | | |
|---|---|---|---|
| 3,292,328 | A | 12/1966 | Lewis et al. |
| 3,609,934 | A | 10/1971 | O'Carroll |
| 3,852,927 | A | 12/1974 | Birum |
| 3,852,935 | A | 12/1974 | Jones |
| 3,982,370 | A | 9/1976 | Buffington |
| 3,986,312 | A | 10/1976 | Calhoun et al. |
| 4,835,923 | A | 6/1989 | Ybarra |
| 4,934,119 | A | 6/1990 | Ybarra |

(Continued)

FOREIGN PATENT DOCUMENTS

WO 9401647 A1 1/1994

OTHER PUBLICATIONS

Nxtwall Demountable Architectural Walls, Flex Series architectural walls, online brochure, downloaded from website Jun. 29, 2022, published on NXTWALL.com, 8 pages.

(Continued)

*Primary Examiner* — Rodney Mintz
(74) *Attorney, Agent, or Firm* — Fredrikson & Byron, P.A.

(57) ABSTRACT

A system includes at least one interior wall having a first interior facing side and a second side opposite the interior facing side, at least one exterior wall having a first interior facing side and a second exterior facing side, at least one first attachment device for each interior wall, and at least one second attachment device for each exterior wall, each first attachment device connecting to a respective second attachment device to temporarily attach a respective interior wall to a respective exterior wall and create a cavity between the second side of the interior wall and the first interior facing side of the exterior wall.

18 Claims, 23 Drawing Sheets

(56) References Cited

U.S. PATENT DOCUMENTS

| | | | | |
|---|---|---|---|---|
| 4,974,386 | A * | 12/1990 | Eriksson | E04H 1/1238 312/111 |
| 6,311,441 | B1 | 11/2001 | Beavers et al. | |
| 8,042,308 | B2 | 10/2011 | Sullivan et al. | |
| 9,212,485 | B2 | 12/2015 | Wolynski et al. | |
| 9,683,363 | B2 | 6/2017 | Pearson et al. | |
| 9,874,010 | B2 | 1/2018 | Gosling | |
| 9,887,049 | B2 | 2/2018 | De La Rosa | |
| 9,926,708 | B1 | 3/2018 | Janko | |
| 10,301,821 | B2 | 5/2019 | Gosling et al. | |
| 10,434,712 | B1 | 10/2019 | Tran | |
| 10,648,180 | B2 | 5/2020 | Clemens | |
| 10,918,963 | B2 | 2/2021 | Ornstein et al. | |
| 11,240,922 | B2 | 2/2022 | Van De Sype et al. | |
| 11,527,344 | B2 | 12/2022 | Kuo | |
| 11,530,535 | B2 | 12/2022 | Lai | |
| 11,674,308 | B1 | 6/2023 | Hammes et al. | |
| 11,939,766 | B2 * | 3/2024 | Hammes | E04B 1/3483 |
| 12,065,823 | B2 * | 8/2024 | Seery | E04B 1/2604 |
| 12,227,933 | B2 * | 2/2025 | Koh | E04B 1/5831 |
| 2004/0255539 | A1 | 12/2004 | Beavers et al. | |
| 2005/0144857 | A1 | 7/2005 | Guerrero | |
| 2008/0120922 | A1 | 5/2008 | Sullivan et al. | |
| 2009/0117311 | A1 | 5/2009 | Kuzmin | |
| 2014/0013695 | A1 | 1/2014 | Wolynski et al. | |
| 2014/0175089 | A1 | 6/2014 | Szulman | |
| 2015/0122194 | A1 | 5/2015 | De La Rosa | |
| 2016/0265218 | A1 | 9/2016 | Gosling | |
| 2016/0356038 | A1 | 12/2016 | Gosling et al. | |
| 2018/0199451 | A1 | 7/2018 | Van De Sype et al. | |
| 2018/0230698 | A1 | 8/2018 | Clemens | |
| 2018/0305924 | A1 | 10/2018 | Buffington et al. | |
| 2019/0209940 | A1 | 7/2019 | Ornstein et al. | |
| 2019/0234070 | A1 | 8/2019 | McDonald et al. | |
| 2019/0234078 | A1 | 8/2019 | McDonald et al. | |
| 2021/0087811 | A1 | 3/2021 | Lai | |
| 2021/0121791 | A1 | 4/2021 | Ornstein et al. | |
| 2022/0013267 | A1 | 1/2022 | Kuo | |
| 2022/0112716 | A1 | 4/2022 | Yokoyama et al. | |
| 2023/0048518 | A1 * | 2/2023 | Seery | E04B 1/1903 |
| 2024/0052630 | A1 * | 2/2024 | Hammes | E04B 1/7675 |
| 2024/0287789 | A1 * | 8/2024 | Koh | E04B 1/34384 |

OTHER PUBLICATIONS

International Searching Authority "International Search Report and Written Opinion" From Application No. PCT/US2023/29926, Mailed Jan. 3, 2024, pp. 11.

* cited by examiner

Example of How the Invention can work in any environment (stud walls, SIP Panels, etc)

Exhibit A: Foundation Plan View

ROOF PANEL

MODULAR REATTACHABLE STRUCTURE SYSTEM AND METHOD

REFERENCE TO RELATED APPLICATIONS

This application is a Continuation of and claims priority to U.S. patent application Ser. No. 18/135,820, filed Apr. 18, 2023, and entitled "MODULAR REATTACHABLE STRUCTURE SYSTEM AND METHOD," the application which is a Continuation of and claims priority to U.S. patent application Ser. No. 17/887,323, filed Aug. 12, 2022, and entitled "MODULAR REATTACHABLE STRUCTURE SYSTEM AND METHOD," now granted as U.S. Pat. No. 11,674,308, the disclosures of each which are incorporated by reference in their entireties.

BACKGROUND

Building and maintaining a building or home can be an extremely expensive and time-consuming task. Even further, the current construction methods are extremely wasteful and not sustainable. Current construction methods also do not allow for structures to be easily rebuilt or reconfigured. In many instances, it is not cost effective to build structures that are temporary or easily damaged due to extreme weather. In particular, in certain climates, there are different issues that can cause havoc. Many cost-effective building strategies have failed for a number of reasons.

It is with these issues in mind, among others, that various aspects of the disclosure were conceived.

SUMMARY OF THE DISCLOSURE

The present disclosure is directed to a modular reattachable structure system and method. The system may include one or more interior walls that may together form an internal space or room. The one or more interior walls may each be attached to one another using at least one attachment device. In addition, each interior wall may be attached to a respective exterior wall that may form an exterior of a structure. Each interior wall may be attached to the exterior wall using a magnetic device. In one example, each interior wall may have a first wall plate that may connect and magnetically attach to a second wall plate that may be incorporated into the exterior wall. The modular reattachable structure system may be used for a single-story structure or may be used to build a multi-story structure.

There may be a cavity or space between each interior wall and each exterior wall that may house objects such as lateral or horizontal plumbing, lateral or horizontal electrical, cabling and/or wiring, and other objects. In addition, in another example, the one or more interior walls may be attached to a respective exterior wall of the structure, and this may serve as the exterior wall. Each interior wall may be detached from the exterior wall to allow for easy access to the objects in the cavity or space between each interior wall and each exterior wall. As a result, the one or more interior walls may create an interior space or room and the exterior walls may protect the interior space or room, together creating a structure. The structure is easily reconfigurable as each interior wall may be detached from the associated exterior wall that may be a shipping container. This may allow for cost effective construction of a permanent structure as well as cost effective construction of a temporary structure. In addition, the structure allows for reconstruction and reconfiguration.

In one example, the system may include a ground rod attachment device comprising at least one upper part connected to a base sill plate of an exterior wall that may comprise (1) a plate having dimensions comprising one of (a) six inches, by six inches, by one inch thick and (b) twelve inches, by six inches, by one inch thick that is attached to a first rod that is tee welded to a concrete stem wall and (2) two cross bars that are set perpendicular to one another and welded to the first rod, and at least one lower part attached to a respective upper part and comprising a second rod to be driven into the ground.

In one example, a system may include at least one interior wall having a first interior facing side and a second side opposite the interior facing side, at least one exterior wall having a first interior facing side and a second exterior facing side, at least one first attachment device for each interior wall, and at least one second attachment device for each exterior wall, each first attachment device connecting to a respective second attachment device to temporarily attach a respective interior wall to a respective exterior wall and create a cavity between the second side of the interior wall and the first interior facing side of the exterior wall.

In another example, a method may include attaching at least one interior wall to one another to create an internal space between the at least one interior wall, attaching a first attachment device incorporated into an exterior face of each interior wall to a second attachment device, the second attachment device incorporated into an interior face of an exterior wall to create a cavity between the exterior face of the interior wall and the interior face of the exterior wall, detaching a particular interior wall from the exterior wall in response to a force applied to the particular interior wall, and replacing the particular interior wall with a new interior wall.

In another example, a system may include at least one wall having a first interior facing side and a second exterior side opposite the interior facing side, at least one first attachment device for each wall, a shipping container, at least one second attachment device for each wall, each first attachment device connecting to a respective second attachment device to temporarily attach a respective interior wall to the shipping container and create a cavity between the second exterior side and an interior wall of the shipping container, and a ground rod attachment device comprising at least one upper part connected to the shipping container comprising (1) a plate having dimensions comprising one of (a) six inches, by six inches, by one inch thick and (b) twelve inches, by six inches, by one inch thick that is attached to a first rod that is tee welded to a concrete stem wall and (2) two cross bars that are set perpendicular to one another and welded to the first rod, and at least one lower part attached to a respective upper part and comprising a second rod to be driven into the ground.

These and other aspects, features, and benefits of the present disclosure will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE FIGURES

The accompanying drawings illustrate embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION OF THE DISCLOSURE

Figure 1:
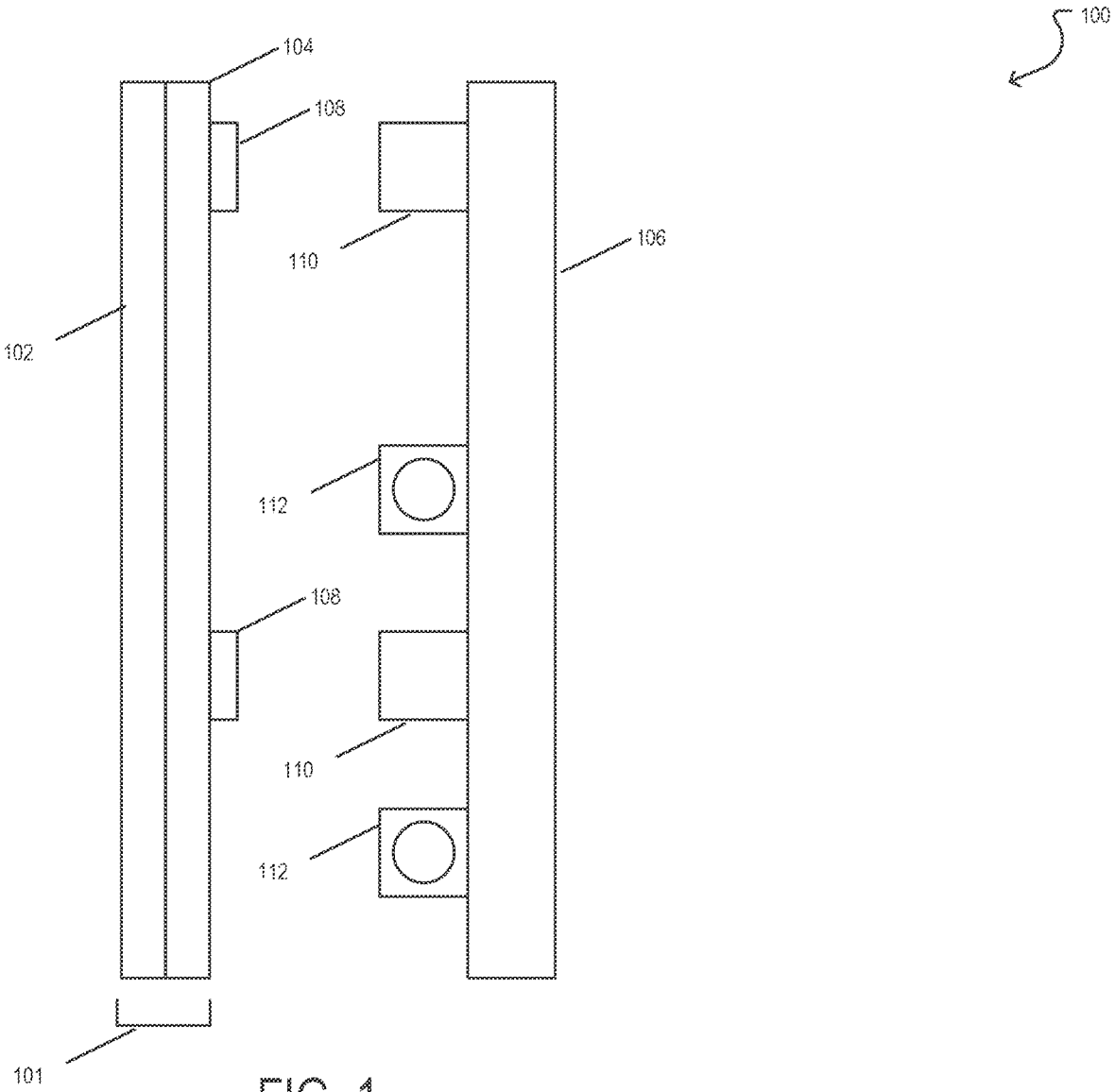
FIG. 1 is a block diagram of a modular reattachable structure system according to an example of the instant disclosure.

The present disclosure is more fully described below with reference to the accompanying figures. The following description is exemplary in that several embodiments are described (e.g., by use of the terms "preferably," "for example," or "in one embodiment"); however, such should not be viewed as limiting or as setting forth the only embodiments of the present disclosure, as the disclosure encompasses other embodiments not specifically recited in this description, including alternatives, modifications, and equivalents within the spirit and scope of the invention. Further, the use of the terms "invention," "present invention," "embodiment," and similar terms throughout the description are used broadly and not intended to mean that the invention requires, or is limited to, any particular aspect being described or that such description is the only manner in which the invention may be made or used. Additionally, the invention may be described in the context of specific applications; however, the invention may be used in a variety of applications not specifically described.

The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. Any signal arrows in the drawings/figures should be considered only as exemplary, and not limiting, unless otherwise specifically noted. Further, the description is not to be taken in a limiting sense, but is made merely for the purpose of illustrating the general principles of the invention, since the scope of the invention is best defined by the appended claims.

It will be understood that, although the terms first, second, etc. may be used herein to describe various elements, these elements should not be limited by these terms. These terms are only used to distinguish one element from another. Purely as a non-limiting example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an," and "the" are intended to include the plural forms as well, unless the context clearly indicates otherwise. It should also be noted that, in some alternative implementations, the functions and/or acts noted may occur out of the order as represented in at least one of the several figures. Purely as a non-limiting example, two figures shown in succession may in fact be executed substantially concurrently or may sometimes be executed in the reverse order, depending upon the functionality and/or acts described or depicted.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

A modular reattachable structure system includes at least one interior wall having a first interior facing side and a second side opposite the interior facing side, at least one exterior wall having a first interior facing side and a second exterior facing side, at least one first attachment device for each interior wall, and at least one second attachment device for each exterior wall, each first attachment device connecting to a respective second attachment device to temporarily attach a respective interior wall to a respective exterior wall and create a cavity between the second exterior facing side of the interior wall and the first interior facing side of the exterior wall.

There may be a cavity or space between each interior wall and each exterior wall that may house objects such as plumbing, electricity, cabling, and other objects. In addition, in another example, the one or more interior walls may be attached to a respective exterior wall of a shipping container and this may serve as the exterior wall. Each interior wall may be detached from the external wall to allow for easy access to the objects in the cavity or space between each interior wall and each exterior wall. As a result, the one or more interior walls may create an internal space or room and the exterior walls may protect the internal space or room, together creating a structure. The structure is easily reconfigurable as each internal wall may be detached from the associated exterior wall. This may allow for cost effective construction of a permanent structure as well as cost effective construction of a temporary structure. In addition, the structure allows for reconstruction and reconfiguration.

The present disclosure has many purposes which include the ability to build and install a modular reattachable structure system and method for building and installing interior wall systems that can be remodeled easily. The interior wall system may include one or more interior walls that may together form an internal space or room. In addition, each interior wall may be attached to a respective exterior wall that may form an exterior of a structure. Each interior wall may be attached to the exterior wall using an attachment device.

In one example, the system may include a ground rod attachment device comprising at least one upper part comprising (1) a plate having various dimensions, one example being (a) six inches, by six inches, by one inch thick that is attached to a first rod that runs vertically down and may or may not run through the foundation and may or may not include cross bars that are set perpendicular to the rod and that may or may not be welded to the rod to increase stability, and connects to at least one lower part that is attached to a respective upper part and at least a second rod that runs down and may or may run down through and past the footer and run down a minimum of six to eight feet into the earth. An electronic switch may or may not be connected to the ground rod where the switch regulates the electricity passing through the ground rod. The switch controls the excess power to the ground rod by diverting the electricity into the earth or passing it through to electrical storage or the existing power grid.

Additionally, the system may include an exterior wall sill plate ground rod attachment device comprising at least one upper part connected to additional rods that can be driven into the ground. The exterior wall sill plate ground rod attachment device may include (1) a plate having dimensions comprising one of (a) six inches, by six inches, by one inch thick and (b) twelve inches, by six inches, by one inch thick that is attached to a first rod that is tee welded to a concrete stem wall and (2) two cross bars that are set perpendicular to one another and welded to the first rod, and at least one lower part attached to a respective upper part and comprising a second rod to be driven into the ground. In other examples, the ground rod attachment device may be attached to a stem wall, pier, and/or slab.

Building and maintaining a building or home can be fun and exciting. To make it more affordable and more efficient, disclosed herein is a system and method to enhance single and multi-story residential and commercial construction methods in a manner that allows current labor supply chains, material supply chains and licensure laws and processes to continue operating as they do today. Through new systems and methods structures can be more easily built, maintained and updated. The systems and methods are effective to build structures that are permanent or temporary, that can withstand high wind loads, flooding, snow loads, earthquakes, and lightning, while creating a cost effective space for residential, commercial or agricultural uses, including commercial retail use.

It is desirable to create durable buildings that can be built in cost conscious ways that allow for low maintenance and that can be temporary or permanent structures. Even further, it is desirable to create highly efficient, durable, low maintenance, cost conscious homes that can be temporary or permanent structures. Additionally, it is desirable to have buildings that can easily be reconfigured with one or more reattachable interior and/or exterior walls.

Traditional drywall and wood stud construction can be replaced with the modular reattachable system that provides a new way to wire and plumb a building. Plumbing lines can be run below the electrical lines in the design, such that condensation does not drip from the water lines and affect any of the wires or systems in the building. The modular design also allows for electrical and plumbing systems to be installed and updated easily.

In one example, the interior walls of a room or space can be magnetized or fixed together using an attachment device such as an alligator style clip. The interior walls can attach, detach, and reattach to each other. Additionally, the interior walls can allow externally adapted items such as light emitting diode (LED) lights, LED screens, shelving units and other items found in residential, commercial and agricultural buildings to be attached to a structural exterior or interior wall.

The dimensions of the exterior and interior structural walls may vary. Structural insulated panels (SIPs) are one example of how to construct an interior wall and/or exterior wall. SIP panels can be cut to a specific custom dimension. As an example, a SIP panel may include two pieces of plywood, steel, or fiberboard. Typically, two pieces of material form around an interior foam insulated core and they can either stand alone as a structural exterior wall, or they can be attached with screws to either an existing wood or metal stud wall, or inside of a shipping container.

In one example, the modular reattachable system can be used with or incorporated into a shipping container to create a building. Shipping containers can be made of Corten steel, a highly corrosion resistant metal, with a medium to low weld-ability factor.

The upper part may include either a (6" wide×6" wide×1" thick) or (16" wide×6" wide×1" thick) metal sill plate attachment that is tee welded to a 3 foot (3 ft) long 1" diameter steel rod that is to be held in place inside of a concrete stem wall. The upper part may have two (2), 1 inch (1") diameter thick×1 inch (1") long cross bars, that are welded to the rod, one at 1 foot (1 ft) from the top of the rod, and the other at 2 feet (2 ft) from the top of the rod. These steel cross rods can be perpendicular to each other when viewing them from the top of the ground rod attachment device, looking down, making a + sign.

The lower part(s) may include one (1) straight 14 foot (14 ft)×1 inch (1") diameter rod that can be driven at least 10 feet (10 ft) into the ground. It can be cut, and it can be connected to a second (2) lower part through the use of a connector if the foundation is greater than 16 feet (16 ft) tall. Multiple lower parts can be connected through the use of the connector, and may not be connected to the horizontal carbon based rebar used by the system. The lower part(s) can replace the existence of vertical rebar in certain locations in the engineering design of the building, while traditional carbon based rebar can still be used in other locations. The base lower part may be driven at least ten feet into the ground before any concrete is poured for the concrete pad or concrete footer. The top of the lower parts can be connected to the upper part through the connector before the concrete is poured into either an insulating concrete form (ICF), concrete masonry unit, or cement block stem wall design or slab.

By selecting a highly corrosion resistant ground rod material, the electrical current can spread out all electrical activity both inside and outside of the building, down through the ground rods, to disperse electricity from the building's power source and any sources of electricity inside or outside of the building, or in the case of lightning strikes or stray electrical activity, down into the earth or into a relay.

The National Electrical Grounding Research Project (NEGRP) by the National Bureau of Standards found that ground rods with 10 mils of copper will likely perform well for 40 years or more in most soil types. Copper degrades in salty environments however, and is very malleable, which can make it difficult to drive into the ground in rocky environments.

As an example, the grounding rod can be made of a martensitic stainless steel, and becomes a ground rod with a layer of oxide to help prevent corrosion in unique environments high in salts. Due to the outside oxide layer, stainless steel is very strong and unlikely to bend or break when installed even in soil with rocks. Martensitic steel is chromium, which usually accounts for 11.5-18% of its composition. Other common components include up to 1.2% carbon, and nickel.

SIP Panels may also be attached directly to foundation concrete block or ICF concrete wall types. As an example, the modular reattachable system could be used on any floor of a building and could be used to create one or more different types of rooms or internal spaces such as basements, bedrooms, living areas, kitchens, bathrooms, mud rooms, retail spaces, warehouses, artist studios, medical clinics, etc.

The modular reattachable system may also be used along with other types of exterior walls such as traditional 2×4 and 2×6 walls, and the magnetic blocks or alligator clamps can be attached directly to the interior of wood or metal studs, or even over drywall that is already attached to the studs through the use of a stud finder.

The modular reattachable system can meet building codes as they may be associated with one or more interior partition walls. The structural exterior walls may have both the structural engineering support for the building as well as the appropriate vapor, fireproofing, and insulation requirements for the building.

Additionally, the modular reattachable system may work in conjunction with interior load bearing and non-load bearing walls. The hardware associated with the modular reattachable system can provide an aperture, space, pocket, chamber, or passage between an exterior wall and an interior wall. In one example, this space or gap between the interior wall and the exterior wall may allow for installation of electrical wiring, plumbing lines, and outlets, among others.

In current construction methods, electrical wiring and plumbing is generally fish eyed through holes cut into the exterior structural walls' studs or metal beams, and runs through or against the insulation of the wall, whether the insulation be foam, rolled in fiberglass, or blown in insulation. This can cause the insulation to deteriorate through condensation from the plumbing lines. It also enables electrical wires to potentially create a fire hazard. However, the modular reattachable system provides a separation of the insulation and the electrical and plumbing lines and reduces the risk of fire and extends the life of the building materials.

As an example, strategic placement and attachment of the interior and exterior structural wall allows for a gap of space that is created between the exterior structural wall, and an interior wall. This can create a cavity of variable depth that will allow various electrical outlet boxes, and plumbing attachment fixtures to be installed or located inside of the gap. The outlets and fixtures can be fixed to the exterior structural wall, so that the boxes and fixtures protrude out to match the depth of the blocks. All electrical boxes in the house could be uniform in depth, 1.25" inches (1.25 in) in depth, as an example.

As an example, interior walls can be detached and reattached to exterior walls easily. By detaching the interior wall, electricians, plumbers, and others can work in an open space to install and maintain new systems, and update or perform maintenance on existing systems. This can assist an owner of the building to address updates of technologies that are constantly evolving, without undergoing expensive home remodeling projects that require the destruction and reconstruction of walls. By removing the interior wall, and updating the electrical wiring and plumbing, the same interior wall, or an entirely new interior wall can be reinstalled, effectively updating the remodeling process in a matter of days, rather than weeks or months. For those who like to simply just update the look and feel of their home, it can allow a do-it-yourselfer (DIY) to entirely rearrange their home. As an example, one can shut down the electricity and plumbing in their home and can remove one or more internal walls. They can move walls around or replace internal walls and update their home in a matter of hours.

Licensed electricians and plumbers will not need to be retrained to understand how to use the modular reattachable structure system. Interior designers can continue to design layouts for homes, and choose color palettes and material choices to build new interior walls. As noted herein, the modular reattachable structure system may utilize magnetic devices and attachment devices to attach and detach the one or more walls. Drywall can still be used as an interior wall finish material, along with just about any other material of choice. The material choice can be associated with the depth of the electrical and plumbing outlets.

If the interior wall is to support cabinets, or cement board and tile, as in the case of a kitchen wall, or a bathroom shower, the wall may utilize a conventional building method in some areas of the building, to prevent insurance claims, injuries, or water damage.

A moisture barrier can be attached to the inside of all exterior walls to prevent condensation from the plumbing lines from penetrating and deteriorating the exterior walls or insulation in the exterior walls. Electrical lines can be hung above and out of the way of any water lines and the plumbing lines can be hung as low as possible along the exterior walls to prevent condensation from the water lines from dripping onto any of the electrical lines causing a short in the electrical system. Plumbing lines can be attached to the exterior wall through the use of plastic or metal fasteners. Plumbing lines can be run along the base of the wall in most cases, with a tee occurring where the line is to run vertically to reach a shower handle valve. These vertical plumbing lines can be run between the vertical and horizontal spaces between the wall attachments, and in the case of a shower handle valve, the plumbing lines for the bathroom may not need to cross paths with the electrical lines, as there should not be electrical lines running behind a shower.

As an example, a small pull style handle or a different type of handle can be attached to the interior wall panels on the side facing the inside of the room, so the panel can easily be detached from the exterior wall and the hardware attached to the exterior wall that was holding it in place.

In one example, the modular reattachable structure system may work and fit inside of a 40 foot×8 foot×9.5 foot high shipping container. This may allow all floors, ceilings and walls to be constructed in a manner that passes international building codes. However, the modular reattachable system can work and fit in any building, created from any building materials. In one example, an electric generator can be attached to an electrical line in the building, so that it can be wired into either a new construction or existing construction building. In another example, an electric generator can emit wireless electrical current and all electrical devices inside or outside of the building can be powered wirelessly. By measuring wall sizes and ordering the appropriate hardware and new interior walls, the generator can be connected through wires or provide wireless energy electrifying current state of the art electrical devices and equipment. This can allow the generator to be installed in older homes that have outdated electrical systems as well as in new construction homes and buildings. By running the electricity deep into the ground, the potential for ground electricity to build up harming livestock, pets and people is reduced.

If traditional carbon based rebar is not used for grounding rods, there are other options. The National Electrical Grounding Research Project (NEGRP) by the National Bureau of Standards found that rods with 10 mils of copper will likely perform well for 40 years or more in most soil types. Copper degrades in salty environments however, and is very malleable, which makes it difficult to drive into the ground in rocky environments.

In one example, the modular reattachable structure system may include a grounding rod be used that is made of a martensitic stainless steel. The grounding rod can have an outside layer of oxide to help prevent corrosion in unique environments high in salts. Due to the outside oxide layer, stainless steel is very strong and unlikely to bend or break when installed even in soil with rocks. Martensitic steel is chromium, which usually accounts for 11.5-18% of its composition. Other common components include up to 1.2% carbon, and nickel. This style of ground rod can survive for 40 years in any type of soil having almost any pH level.

By combining the use of magnetic pocket blocks and alligator clips to create new pockets between new interior walls and exterior structural walls, newer electrical and plumbing systems can easily be installed and maintained. As new buildings become entirely powered more frequently by electricity, the concept of a ground rod system that is dispersed throughout the buildings foundation is a unique way to accommodate the electrical power used in the construction methods of the future.

FIG. 1 is a block diagram of a modular reattachable structure system 100 according to an example of the instant disclosure. As shown in FIG. 1, the modular reattachable structure system 100 may include one or more interior or internal walls 101 having a first interior face 102 and a second exterior face 104. The modular reattachable structure system 100 may include one or more external or exterior walls 106. The exterior wall 106 may have a first interior face and a second exterior face similar to the first interior wall 101.

The second exterior face 104 of the interior wall 101 may have a first attachment point or device 108 and the exterior wall 106 may have a second attachment point or device 110 that attaches to the first attachment point or device 108. The first attachment point or device 108 and the second attachment point or device 110 may each be a magnetic device or another type of attachment device. Additionally, there may be one or more electrical outlet boxes or plumbing leads 112.

In one example, the interior face 102 may be an interior finished wall that may include drywall, fiberglass, wood, light emitting diode (LED) touchscreens, preprinted digital art, and other objects. The interior support wall or second face 104 may be constructed of plastic, steel, plywood, and/or fiberglass and may have one or more openings or spaces for electrical and plumbing to protrude from the exterior wall 106 into the second face 104. The first attachment point or device 108 and the second attachment point or device 110 may be structural connection hardware. The first attachment point or device 108 may be a first magnetic object that may be attached or screwed to the second face 104 and the second attachment point or device 110 may be a second magnetic object that may be attached or screwed to the exterior wall 106. Each of the first magnetic object and the second magnetic object may have one or more high strength magnets that may connect and attach to one another through their polarity.

In another example, an interior wall 101 may attach to another internal wall 101. In one example, the exterior face 104 of one interior wall may attach to another exterior face of the other internal wall 101. In other words, the first attachment point or device 108 is not limited to attaching or being magnetically attracted to the second attachment point or device 110. The first attachment point or device 108 can attach or be magnetically attracted to another first attachment point or device 108.

As an example, the structural walls including the interior wall 101 and the exterior wall 106 may be a structural wall that can include a SIP panel (e.g., steel/insulation/steel for metal buildings or plywood/insulation/plywood, or another combination based on geography. They also may include 2"×4" or 2"×6" wood studs or metal studs. Exterior structural walls may have insulation and may include a vapor and/or moisture barrier for the modular reattachable structure system 100 and an associated building. The exterior structural walls may be fireproof rated HSBC. A minimum thickness may be based on a structural engineering recommendation. Each of the electrical outlet boxes or plumbing boxes may be 1.25" in depth. As an example, the plumbing boxes may house a crimp or an elbow.

Figure 2:
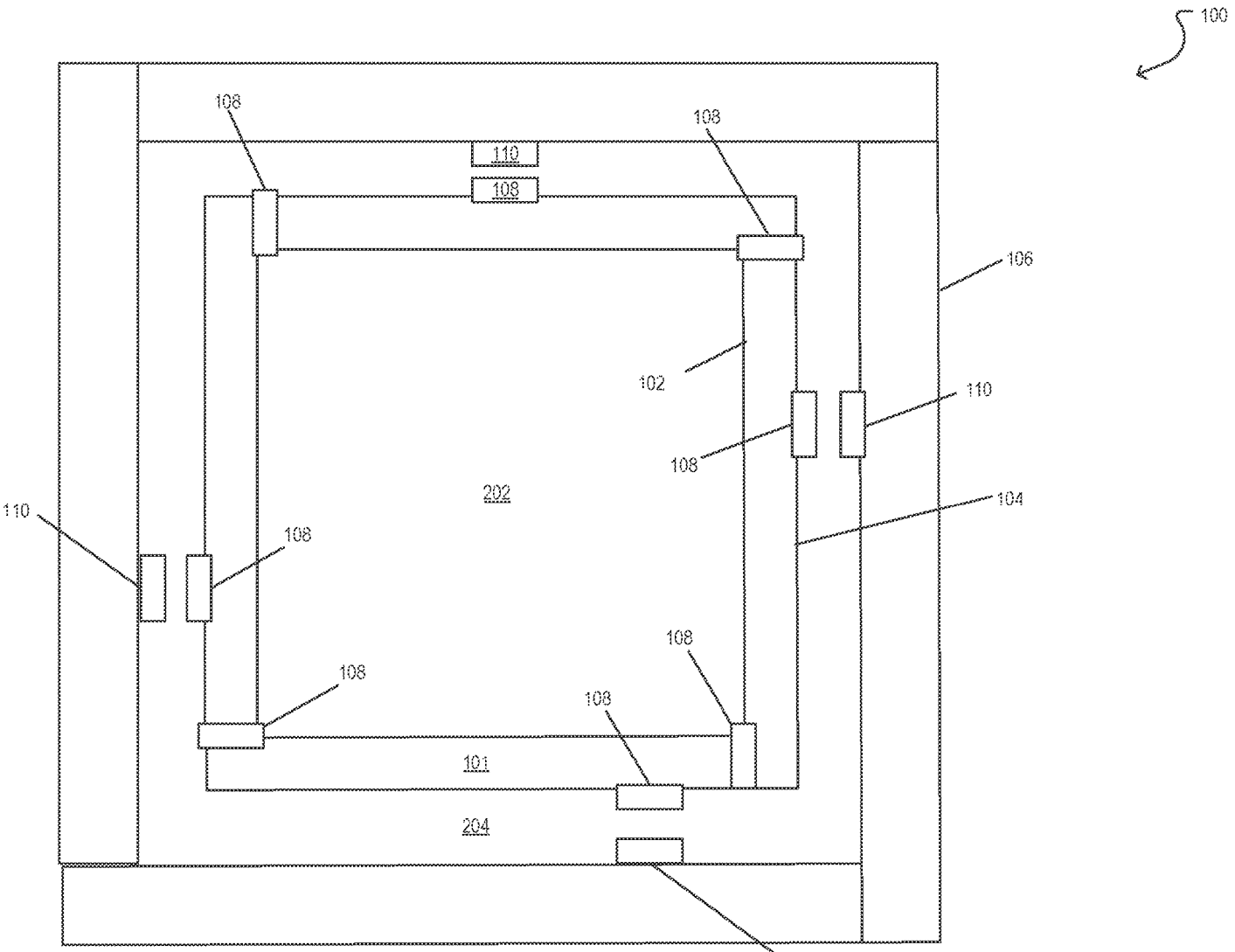
FIG. 2 is another block diagram of the modular reattachable structure system according to an example of the instant disclosure.

FIG. 2 shows another block diagram of the modular reattachable structure system 100 according to an example of the instant disclosure. As shown in FIG. 2, there may be one or more interior walls 101 having the first interior face 102 as well as the second exterior face 104. Each of the one or more interior walls 101 may together create an internal space or room 202. In addition, there may be one or more exterior walls 106 that protect the one or more interior walls 101. There may be a space 204 or cavity that is created between the exterior structural wall 106, and the interior wall 101. This can create a cavity of variable depth that will allow various electrical outlet boxes, and plumbing attachment fixtures to be installed or located inside of the gap 204. The outlets and fixtures can be fixed to the exterior structural wall 106, so that the boxes and fixtures protrude out to match the depth of the blocks. The depth of the blocks may or may not be the same in various parts of the building. In one example, all electrical boxes in the house, could be 1.25" inches (1.25 in) in depth, as an example.

Each interior wall 101 may have the first attachment device or magnet 108 that attaches to a respective second attachment device 110 on the exterior wall 106. As noted above, the first attachment point or device 108 may be a first magnetic object that may be attached or screwed to the second face 104 and the second attachment point or device 110 may be a second magnetic object that may be attached or screwed to the exterior wall 106. Each of the first magnetic object and the second magnetic object may have one or more high strength magnets that may connect and attach to one another through their polarity. As further noted above, the first attachment point or device 108 is not limited to attaching or being magnetically attracted to the second attachment point or device 110. The first attachment point or device 108 can attach or be magnetically attracted to another first attachment point or device 108.

Figure 3:
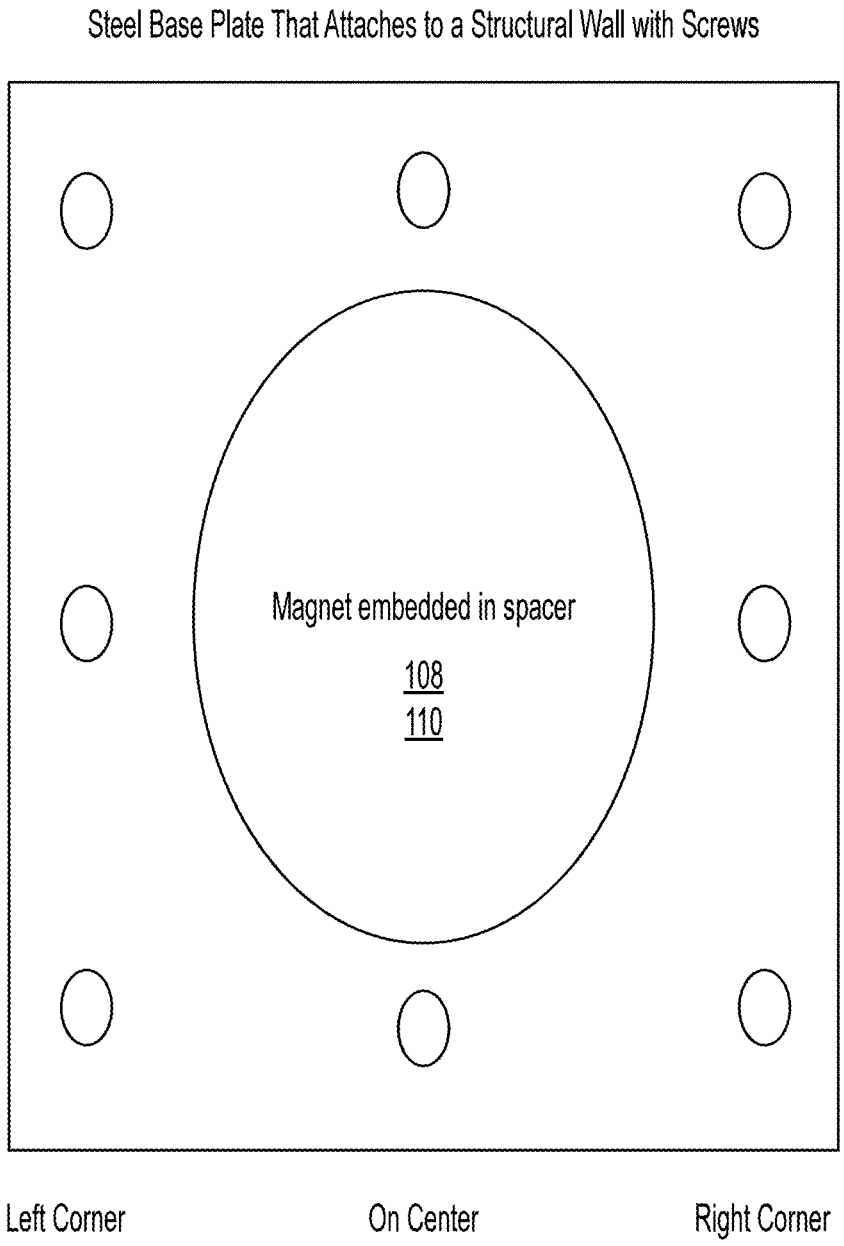
FIG. 3 shows an example of an attachment device to attach at least one interior wall of the modular reattachable structure system according to an example of the instant disclosure.

FIG. 3 shows an example of the first attachment device 108 and the second attachment device 110 to attach the least one interior wall 101 of the modular reattachable structure system 100 according to an example of the instant disclosure. As shown in FIG. 3, the attachment device may be a magnetic device that may be housed in the space 204 between the interior wall 101 and the exterior wall 106. The first attachment point or device 108 may be a first magnetic object that may be attached or screwed to the second face 104 and the second attachment point or device 110 may be a second magnetic object that may be attached or screwed to the exterior wall 106. Each of the first magnetic object and the second magnetic object may have one or more high strength magnets that may connect and attach to one another through their polarity.

As shown in FIG. 3, the first attachment device, e.g., magnet 108, and the second attachment device, e.g., magnet 110, may be housed in the space 204 between the interior wall 101 and the exterior wall 106. The first attachment device, e.g., magnet 108, and the second attachment device, e.g., magnet 110, may be part of a steel base plate that may attach to the structural wall with one or more attachment devices such as screws.

Figure 4:
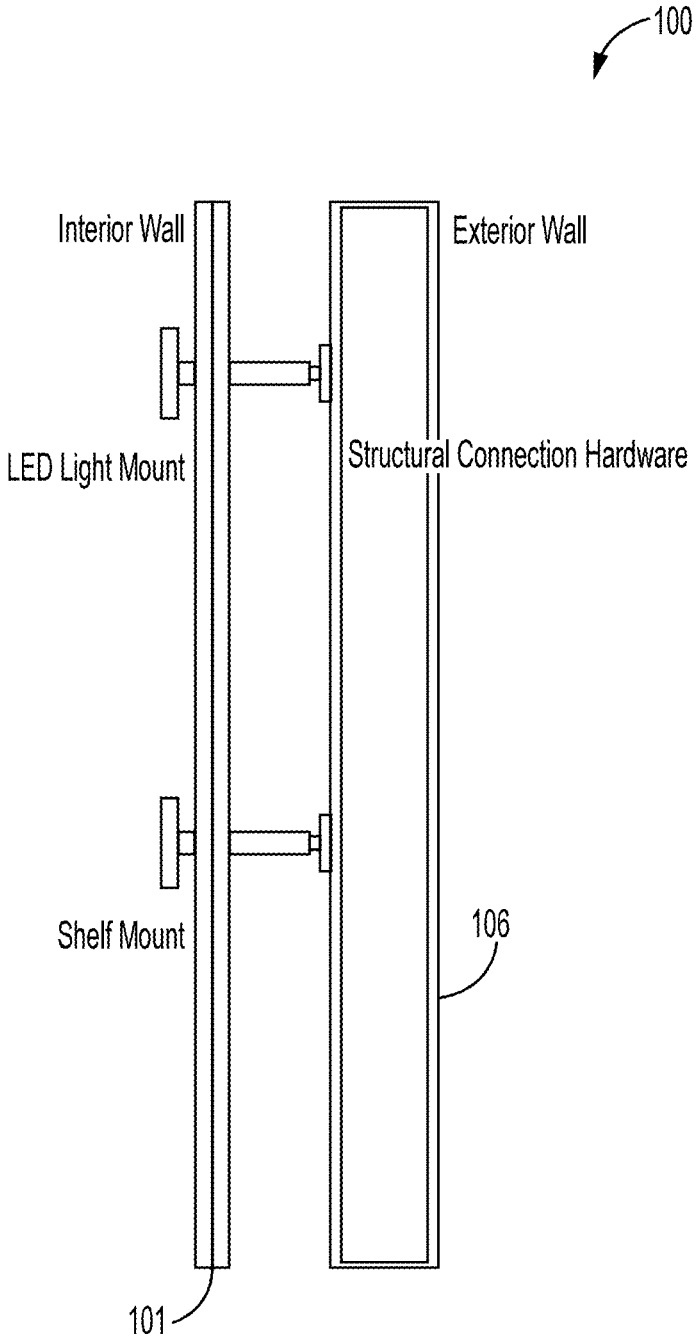
FIG. 4 shows another view of the modular reattachable structure system according to an example of the instant disclosure.

FIG. 4 shows another view of the modular reattachable structure system 100 according to an example of the instant disclosure. As shown in FIG. 4, the interior wall 101 may have light emitting diode (LED) light mounts, shelf mounts, and other objects that may connect with the exterior wall 106 through the space 204. As an example, the objects may be held or attached to the interior wall 101 using hardware pieces that will attach to the exterior wall 106 for structural support, and will protrude through the gap and out through the interior wall 101, so that devices like LED lights, speakers, artwork, shelves, or any other device can be hung from the interior wall 101, and can also be easily replaced with newer fixtures during a remodeling process. Nails or screws do not have to be removed. In addition, the devices may have a similar attachment style, allowing manufacturers to create new styles of devices that can be easily hung. Although electrical wiring is required for the use of certain devices and appliances today, in the future, the modular reattachment structure system 100 allows use of wireless or wired LED lighting, wireless or wired speakers, wireless or wired kitchen cooking ovens and cooktops, wireless or wired refrigerators, wireless or wired microwaves, wireless or wired washers and dryers, wireless or wired water heaters, wireless or wired motion detectors, wireless or wired cameras, wireless or wired heating and cooling devices, wireless or wired composting toilets, wireless or wired fans, and wireless or wired garbage disposals, wireless or wired LED and future visual media displays, wireless or wired microphones, wireless or wired artwork, and any other wireless or wired electronic devices, among others that may be hung or attached to the interior walls 101.

Figure 5:
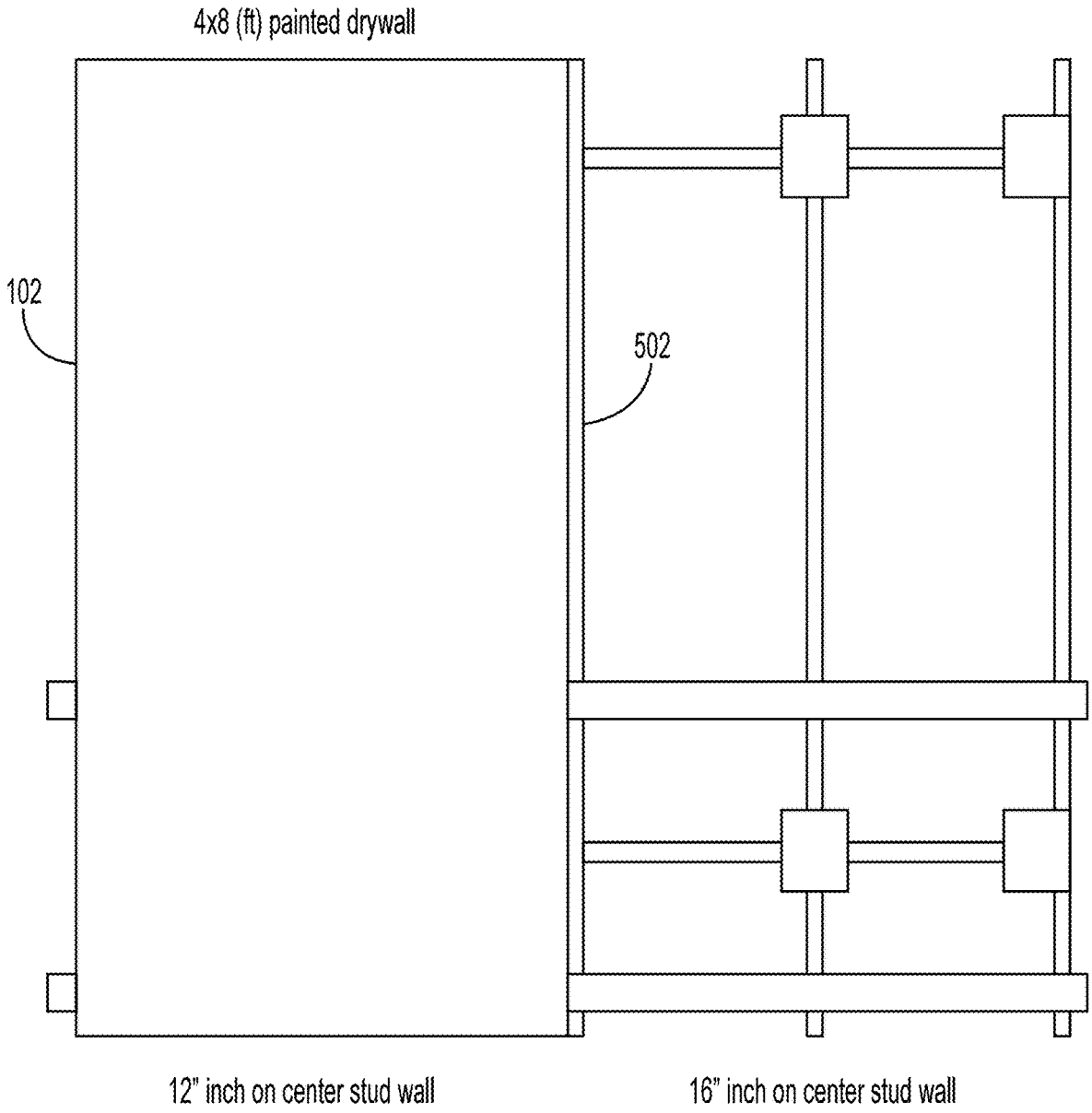
FIG. 5 shows an interior view of one interior wall of the modular reattachable structure system according to an example of the instant disclosure.
Figure 17B:
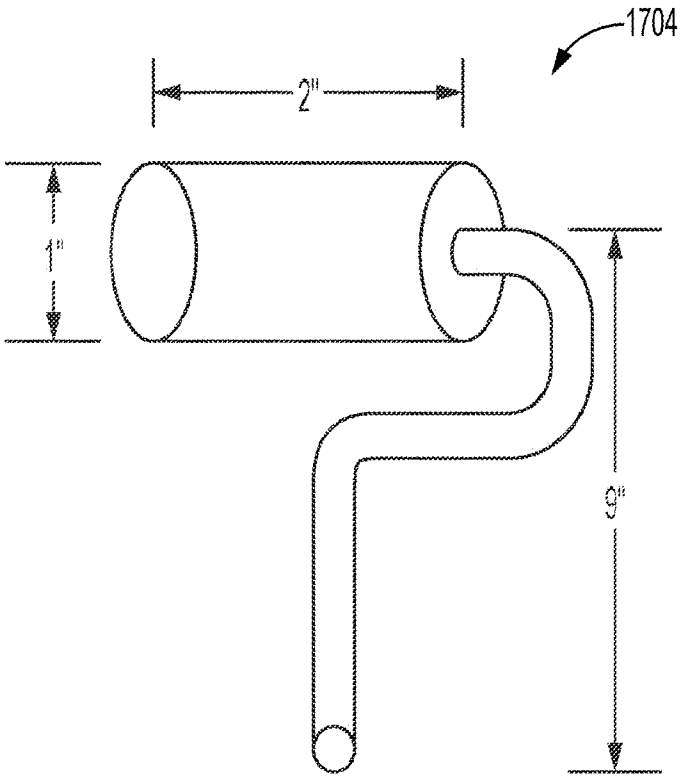
FIGS. 17A and 17B illustrate a roll of drywall seamer tape according to an example of the instant disclosure.
Figure 17A:
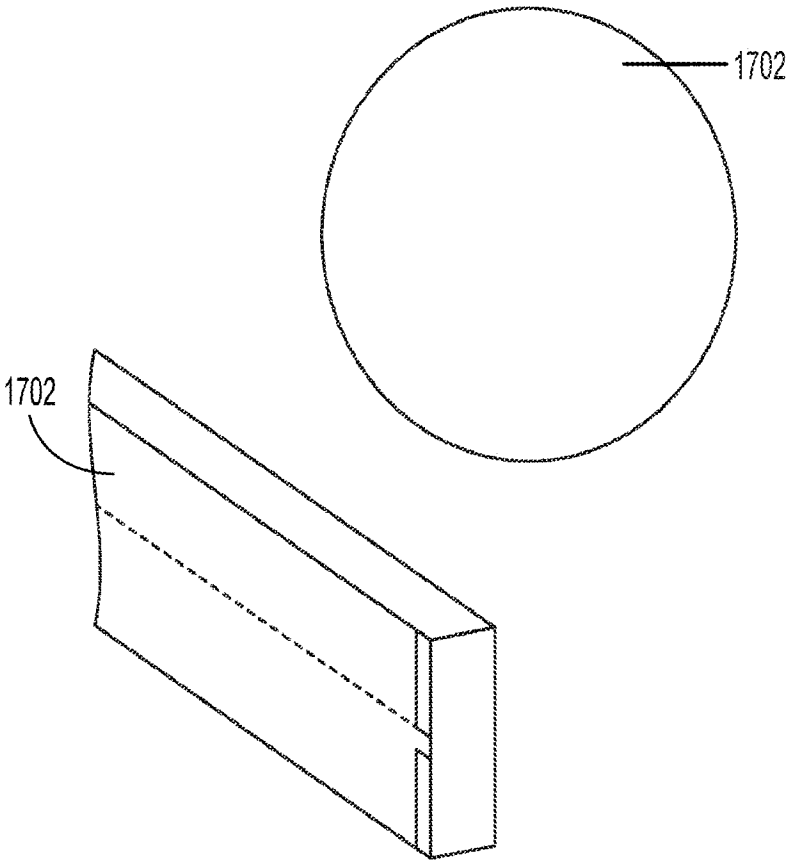

FIG. 5 shows an interior view of one interior wall 502 of the modular reattachable structure system 100 according to an example of the instant disclosure. As shown in FIG. 5, the interior wall 502 may be associated with one or more sections of drywall that may be painted or covered in another way such as shown in FIGS. 17A and 17B.

Figure 6:
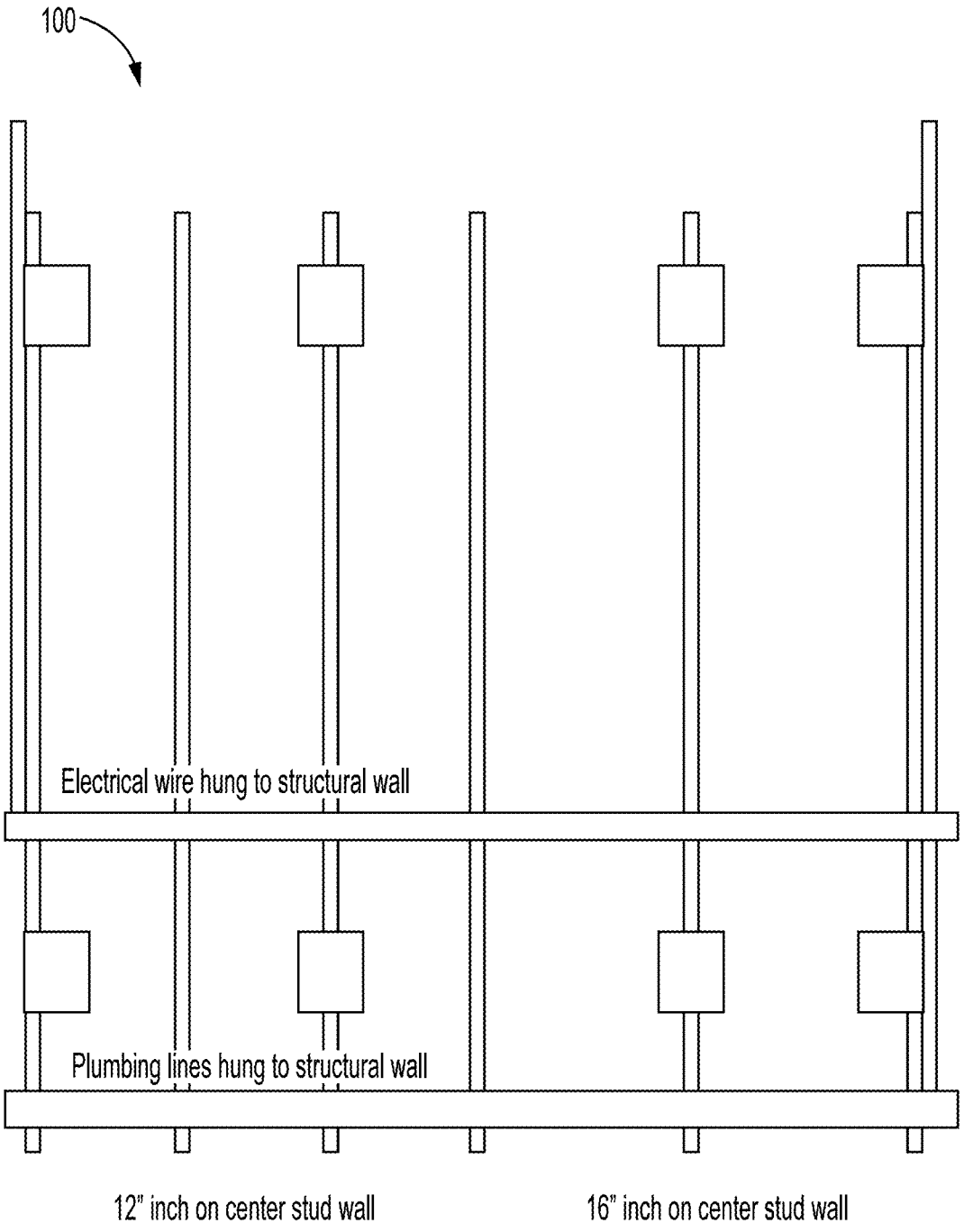
FIG. 6 shows a view behind an interior wall of the modular reattachable structure system according to an example of the instant disclosure.

FIG. 6 shows a view behind the interior wall 101 of the modular reattachable structure system 100 according to an example of the instant disclosure. As shown in FIG. 6, electrical wire may be hung to a structural wall and plumbing lines may be hung to the structural wall, among other things.

Figure 7:
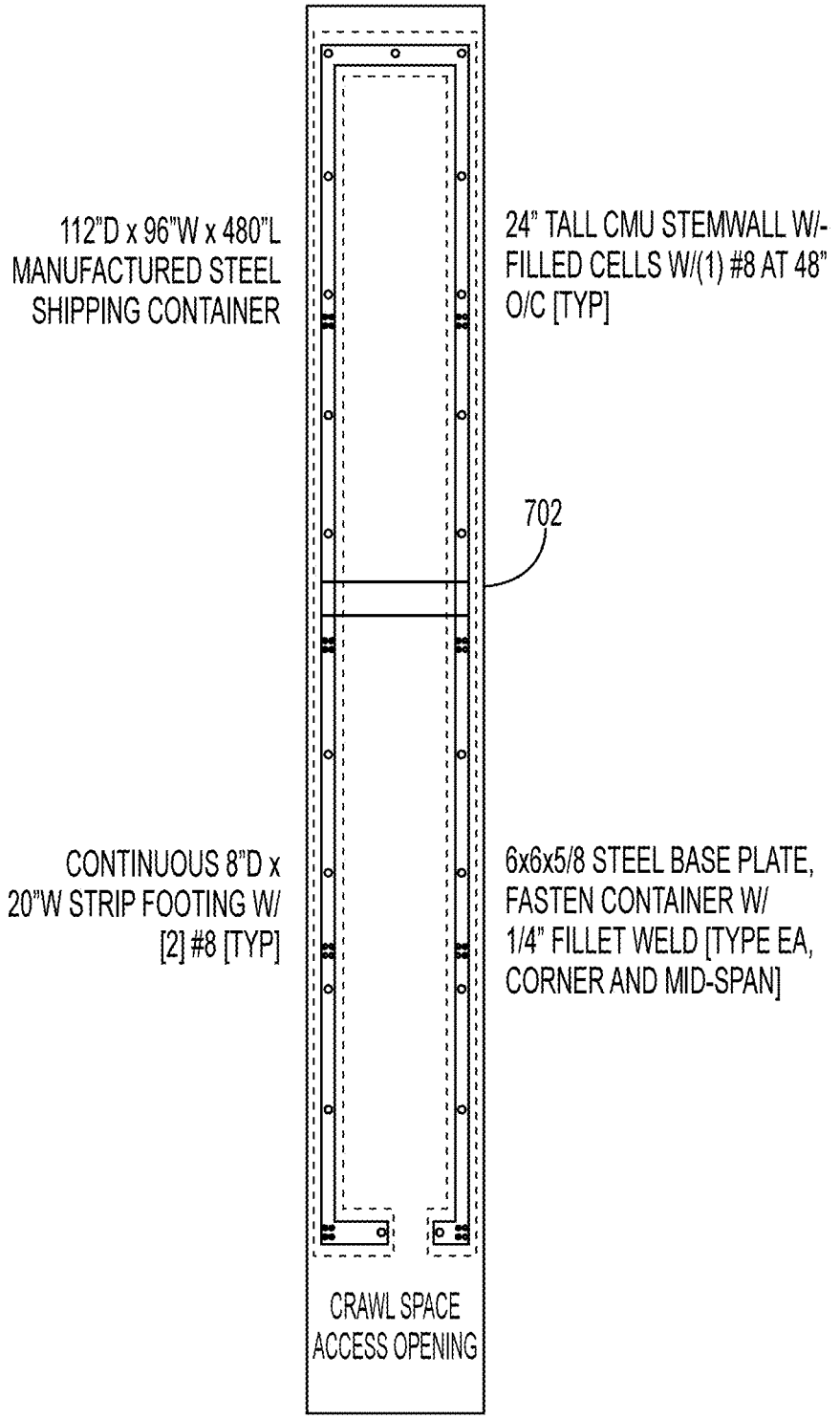
FIG. 7 shows an example of the modular reattachable structure system within a shipping container according to an example of the instant disclosure.

FIG. 7 shows an example of the modular reattachable structure system 100 within a shipping container 702 according to an example of the instant disclosure. As shown in FIG. 7, there may be one or more internal walls 101 that may be within the shipping container 702 and the internal sides of the shipping container may serve as the one or more external walls 106.

Figure 8:
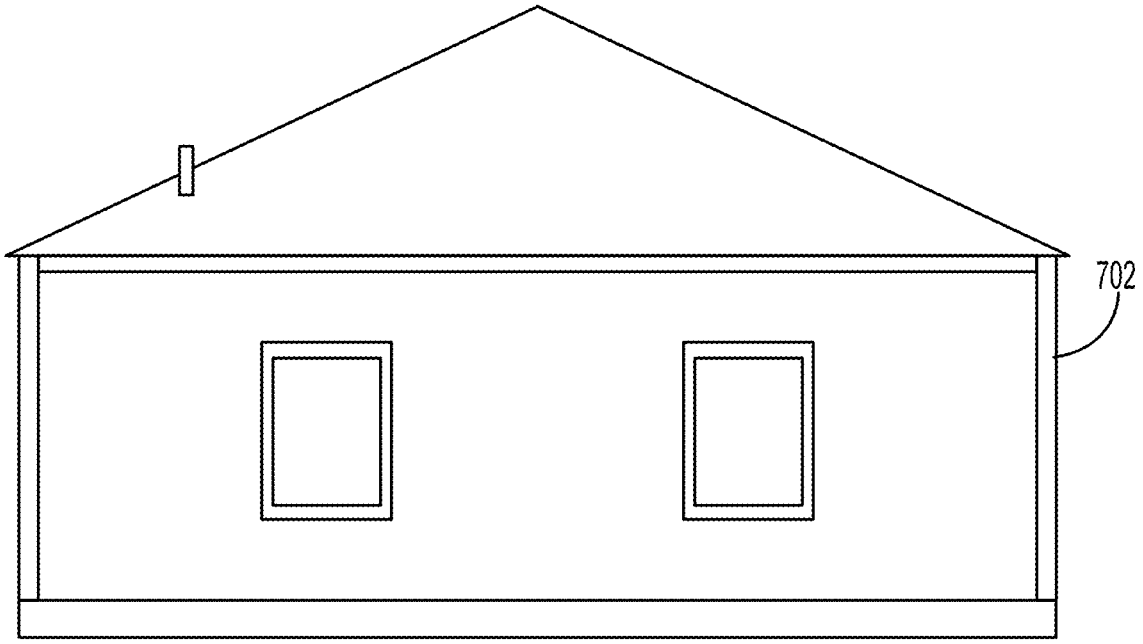
FIG. 8 shows an example back exterior view of the modular reattachable structure system within the shipping container according to an example of the instant disclosure.

FIG. 8 shows an example back exterior view of the modular reattachable structure system 100 within the shipping container 702 according to an example of the instant disclosure. As shown in FIG. 8, there is a roof on the shipping container. As shown in FIG. 8, there may be a hip roof or a hipped roof on the modular reattachable structure system 100 as well as the shipping container 702. In addition, as shown in FIG. 8, there may be one or more windows associated with the shipping container 702.

Figure 9:
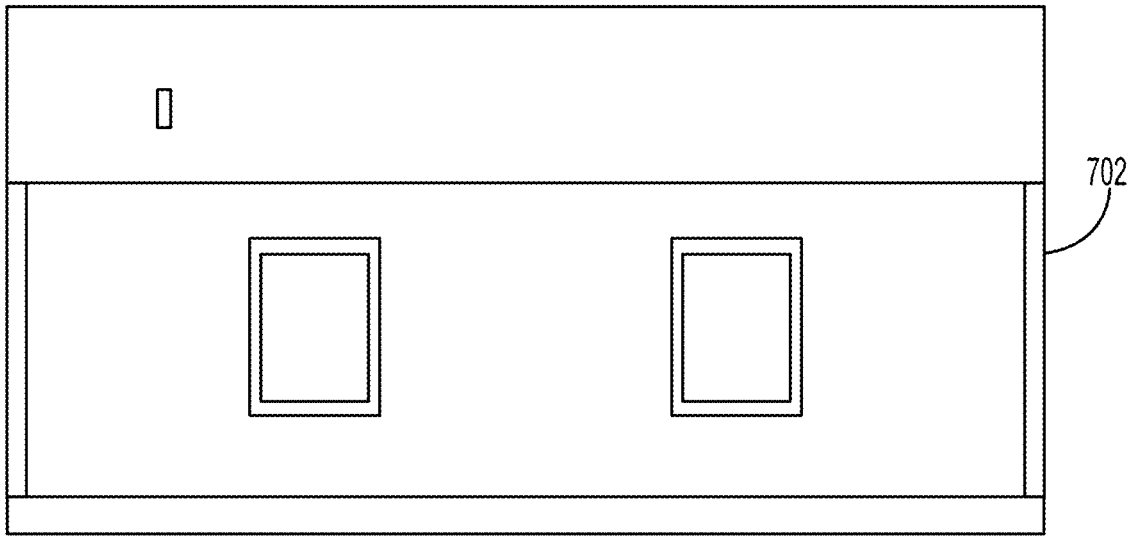
FIG. 9 shows another example back exterior view of the modular reattachable structure system within the shipping container according to an example of the instant disclosure.

FIG. 9 shows another example back exterior view of the modular reattachable structure system 100 within the shipping container 702 according to an example of the instant disclosure. As shown in FIG. 9, there is a flat roof on the shipping container.

Figure 10:
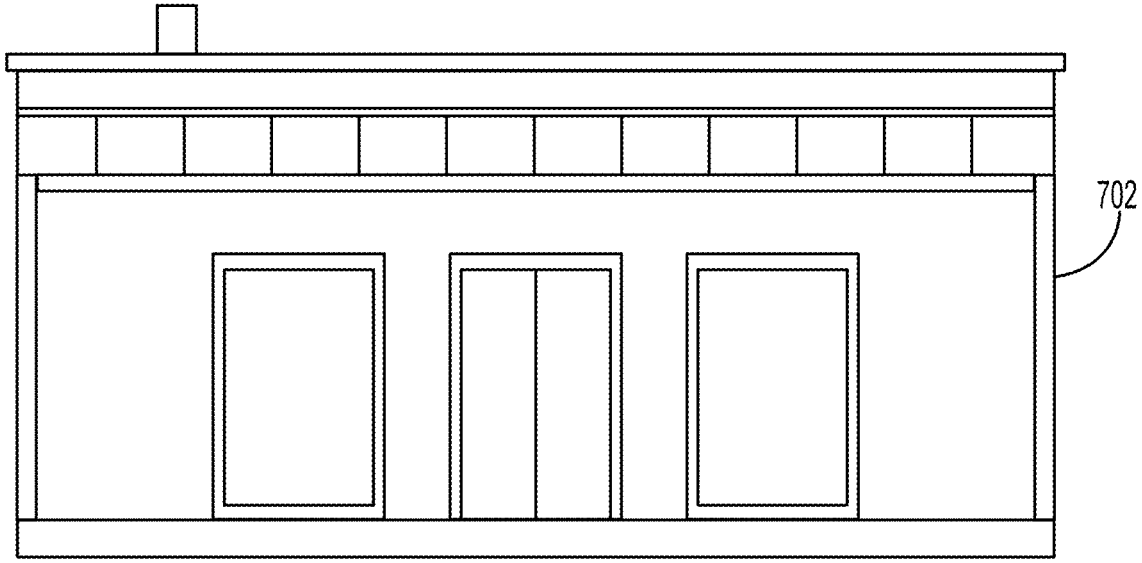
FIG. 10 shows an example front exterior view of the modular reattachable structure system within the shipping container according to an example of the instant disclosure.

FIG. 10 shows an example front exterior view of the modular reattachable structure system 100 within the shipping container 702 according to an example of the instant disclosure. As shown in FIG. 10, there may be a hip roof or a hipped roof on the modular reattachable structure system 100 as well as the shipping container 702. As shown in FIG. 10, there may be one or more windows as well as one or more doors associated with the shipping container 702.

Figure 11:
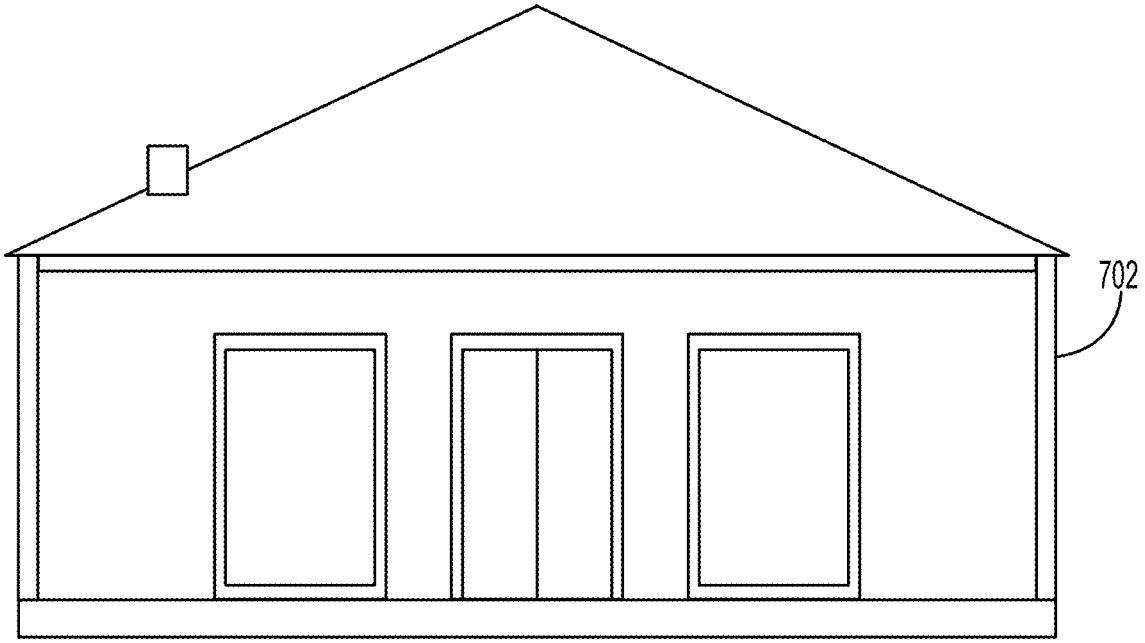
FIG. 11 shows another example front exterior view of the modular reattachable structure system within the shipping container according to an example of the instant disclosure.

FIG. 11 shows another example front exterior view of the modular reattachable structure system 100 within the shipping container 702 according to an example of the instant disclosure. As shown in FIG. 11, there is a flat roof on the shipping container 702.

Figure 12:
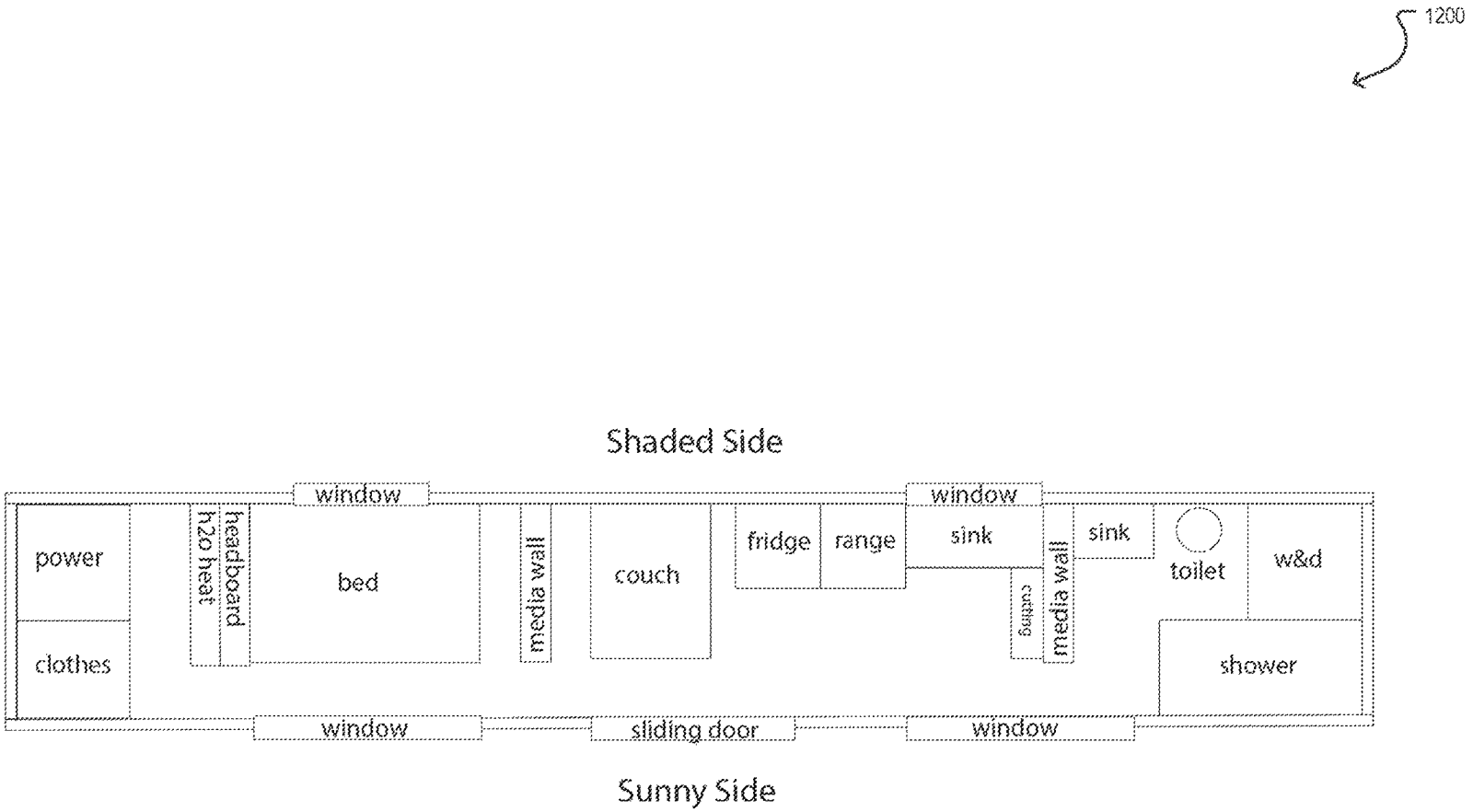
FIG. 12 shows an example floor plan within the interior walls of the modular reattachable structure system according to an example of the instant disclosure.

FIG. 12 shows an example floor plan 1200 within the interior walls of the modular reattachable structure system 100 according to an example of the instant disclosure. As shown in FIG. 12, there may be one or more rooms or spaces 202 within the interior walls that may house objects such as one or more beds, a refrigerator, a range, a sink, one or more bathrooms, and one or more closets or storage areas.

Figure 13:
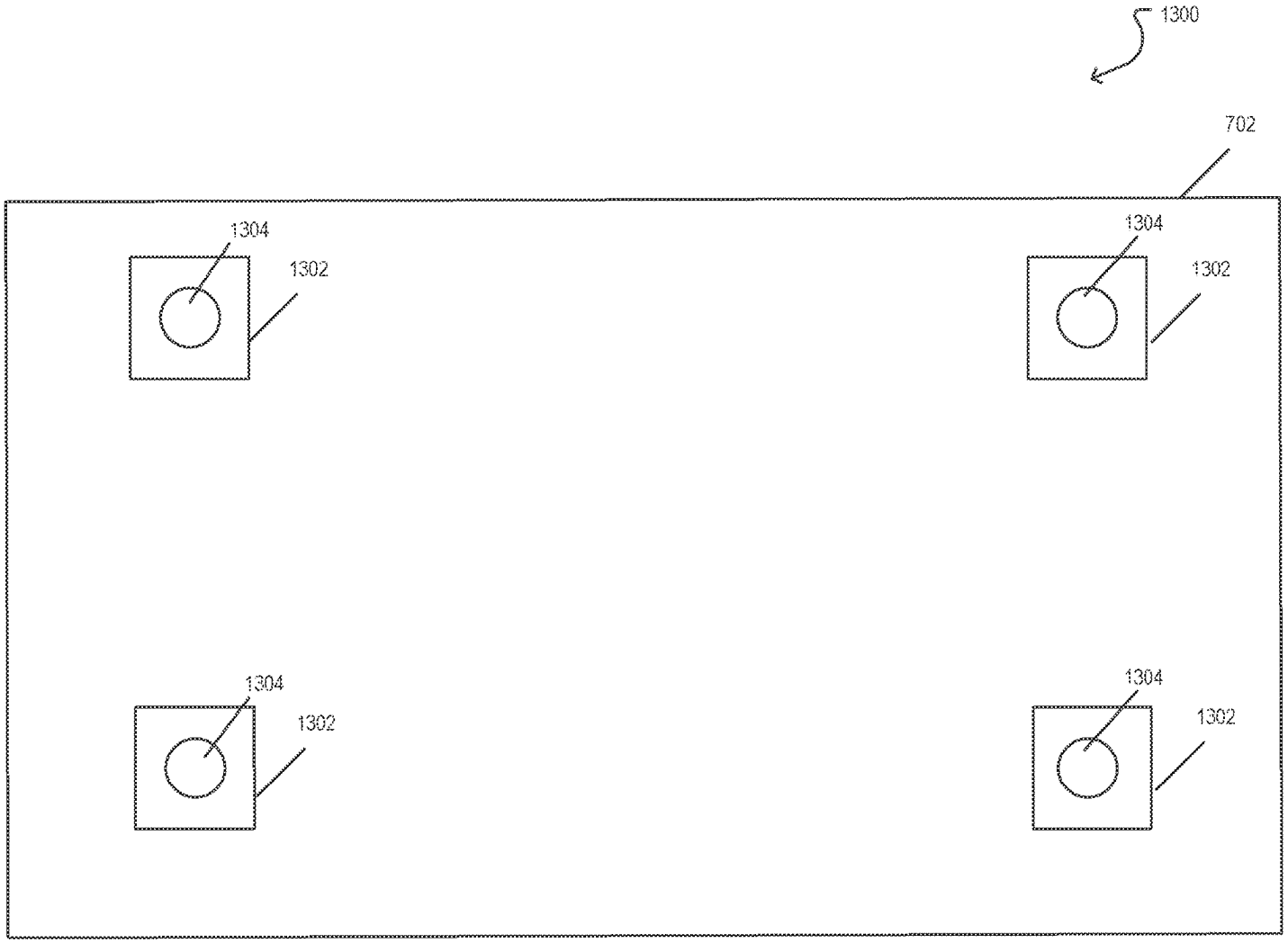
FIG. 13 is a block diagram of a ground rod attachment device of the modular reattachable structure system according to an example of the instant disclosure.
Figure 14:
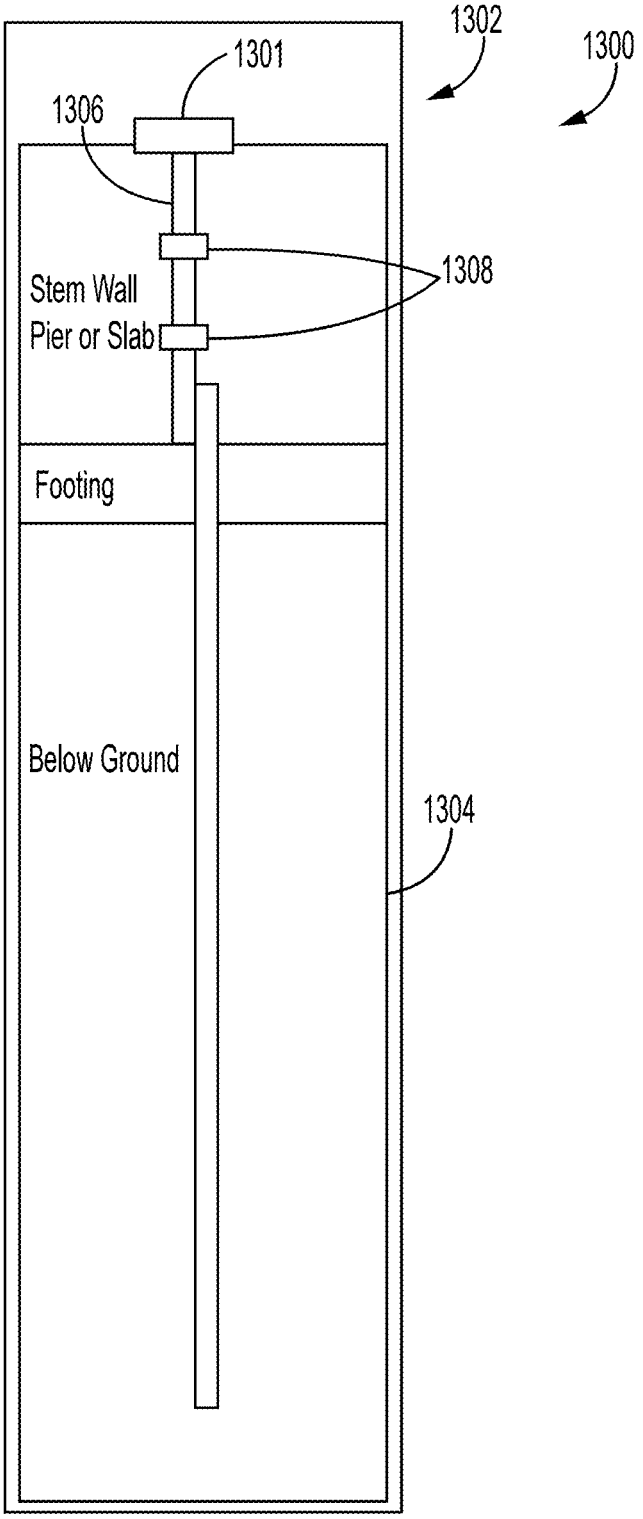
FIG. 14 illustrates another diagram of the ground rod attachment device of the modular reattachable structure system according to an example of the instant disclosure.

FIGS. 13 and 14 show a ground rod attachment device 1300 of the modular reattachable structure system 100 according to an example of the instant disclosure. As shown in FIGS. 13 and 14, the modular reattachable structure system 100 can include a ground rod attachment device 1300 that can be used to attach the structure including the one or more exterior walls 106 and/or interior walls 101 to a shipping container 702.

As an example, the ground rod attachment device 1300 can be used and set on multiple types of foundations including concrete foundations. Piers can be used in geographies that are extremely wet such as islands, and in coastal areas that are known for flooding and are prone to heavy rains and hurricanes. Piers and stem walls can be built to a particular height to address local flood codes. Slabs can be used where there may not be plumbing in the building, and can be set on the ground and raised on top of a mound of compacted earth at any height to surpass local flood codes. In the case of a slab, plumbing can be added underneath the slab and brought up into the building through the slab or brought in from any direction to supply water to the inside and or outside of building. Water lines can run horizontally or vertically and plumbing stacks and water lines and drains can be attached at the local building code slopes.

The system 100 can be either physically joined, or separate from a greenhouse to create a self-sustainable living quarters that can both provide shelter as well as nutrition, sunlight, an area to raise animals, insects, flowers, herbs, and vegetables and can be temperature and humidity modified, electrically.

As an example, to attach a single shipping container to the earth, or areas with less than 139 mph wind design speed codes and less than 3 ft flood zone codes, the ground rod attachment system 1300 can include six upper parts 1302 with top plate dimensions of (6" wide×6" wide×1" thick) and six lower parts 1304. For areas with above 139 mph wind design speed codes and greater than 3 ft flood zone codes, or for areas that are prone to earthquakes, the system can include ten upper parts 1302 with top plate dimensions of (12" wide×6" wide×1" thick) and 12 lower parts 1304 can be used for stem walls no more than 3 feet tall, or 24 lower parts 1304 where stem walls are greater than 3 feet and less than 16 feet.

As an example, to attach a single shipping container to the earth, the upper part 1302 may include either a (6" wide×6" wide×1" thick) or (12" wide×6" wide×1" thick) plate 1301 that is tee welded to a 3 foot (3 ft) long 1" diameter rod 1306 that is to be held in place inside of a concrete stem wall. The upper part 1302 may have two (2), 1 inch (1") diameter thick×1 inch (1") long cross bars 1308, that are welded to the rod, one at 1 foot (1 ft) from the top of the rod, and the other at 2 feet (2 ft) from the top of the rod. These cross rods 1308 can be perpendicular to each other when viewing them from the top of the system, looking down, making a + sign.

As shown in FIG. 14, below the plate 1301 can be the stemwall, pier, or slab running vertically down under the building or structure, through a foundation of the building.

As an example, to attach a shipping container to the earth, the lower part(s) 1304 may include one (1) straight 14 foot (14 ft)×1 inch (1") diameter rod that can be driven at least 10 feet (10 ft) into the ground. It can be cut, and it can be connected to a second (2) lower part through the use of a steel rebar tie if the foundation is greater than 16 feet (16 ft) tall. Multiple lower parts 1304 can be connected through the use of steel rebar ties, and may not be connected to the horizontal carbon based rebar used by the system. The lower part(s) 1304 can replace the existence of vertical rebar in certain locations in the engineering design of the building, while traditional carbon based rebar can still be used in other locations. The base lower part may be driven at least ten feet into the ground before any concrete is poured for the concrete pad or concrete footer. The top of the lower parts 1304 can be connected to the upper part 1302 through a steel rebar tie before the concrete is poured into either an ICF, concrete masonry unit, or cement block stem wall design.

As an example, to attach a shipping container to the earth, by selecting a highly corrosion resistant metal the building may act as a 40+ year ground rod, that can spread out all electrical activity both inside and outside of the building, down through six to ten ground rods, to distribute electricity from the steel shipping container and any sources of electricity in the building, or in the case of lightning strikes or stray electrical activity, down into the ground.

As an example, to attach a shipping container to the earth, the upper part 1302 can be positioned 4 inches (4") from each of the (4) shipping container corner posts under the shipping container side rails, along the top of the stem wall, as well as at the 2 midpoints of the stem wall, where the shipping container side rails will sit on top of the ground rod attachment device 1300 which will be set inside of concrete in the stem wall. If the upper part 1302 is used in conjunction with concrete masonry units or concrete blocks, the height of the top row of blocks used to create the concrete masonry unit or concrete block will need to be reduced by 1 inch (1")×6 inches (6") on all four (4) corners and in the two (2) midpoints where the (6" wide×6" wide×1" thick) top plates are designed to sit on the top row of the concrete stem wall and below the side rails of the shipping container. As a result, the shipping container side rails can sit flush with the top of the stem wall and the top of the upper parts 1302.

As an example, to attach a shipping container to the earth, in areas prone to earthquakes, or where wind design speeds above 139 mph are needed, it is possible to add four (4) additional upper parts 1302 to the system, by adding two (2) additional upper parts 1302 on each of the long sides of the stem wall, with one (1) being set in between the corner and the midpoint in all four (4) quadrants of the stem wall. As an example, the system can include a top plate 1301 that is twelve inches wide (12" wide×6" wide×1" thick) and can be turned 90 degrees (90) so the longer twelve inch (12") wide side is perpendicular to the side rail of the shipping container, and it can sit across a twelve inch (12") wide insulating concrete form (ICF) wall and be held in place by the foam of the stem wall before the concrete is poured inside of the stem wall. In this case, the top of the ICF wall foam can be reduced by one inch (1") in depth×6 inch (6 in) in length. In the exact ten (10) locations the upper part 1302 and a coinciding top plate can sit flush with the top of the ICF foam form.

As an example, the grounding rod, e.g., the lower part 1304 can be made of a martensitic stainless steel, and becomes a ground rod with a layer of oxide to help prevent corrosion in unique environments high in salts. Due to the outside oxide layer, stainless steel is very strong and unlikely to bend or break when installed even in soil with rocks. Martensitic steel is chromium, which usually accounts for 11.5-18% of its composition. Other common components include up to 1.2% carbon, and nickel.

In further examples, the modular reattachable structure system 100 may be used for a single story structure or may be used to build a multi-story structure.

Figure 15A:
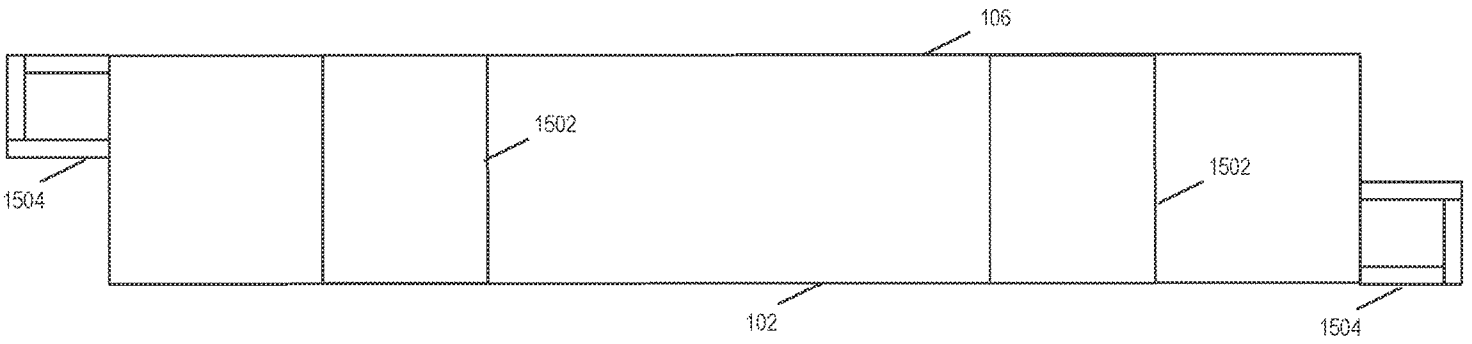
FIG. 15A illustrates a cross-section view of the modular reattachable structure system according to an example of the instant disclosure.
Figure 15B:
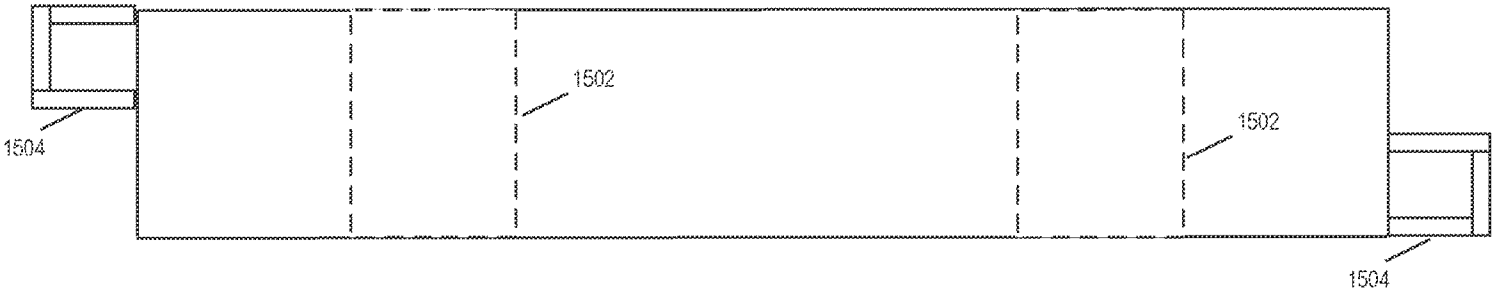
FIG. 15B illustrates a top view of the modular reattachable structure system according to an example of the instant disclosure.

FIG. 15A illustrates a cross-section view of the modular reattachable structure system 100 according to an example of the instant disclosure. FIG. 15B illustrates a top view of the modular reattachable structure system 100 according to an example of the instant disclosure. As shown in FIG. 15A and FIG. 15B, there may be one or more instances of plumbing/electrical 1502 in the cavity the exterior wall and the exterior face of the exterior wall 106. As an example, the instance of plumbing/electrical 1502 in the cavity 204 may be a chase or wet wall/section for the plumbing/electrical. This may route the plumbing/electrical 1502 between floors/stories in a multi-story structure. Additionally, there may be one or more connections 1504 that may be used to attach a first exterior or external wall 101 to a second exterior or external wall 101 or attach a first exterior or external wall 106 to a second exterior or external wall 106.

Figure 16:
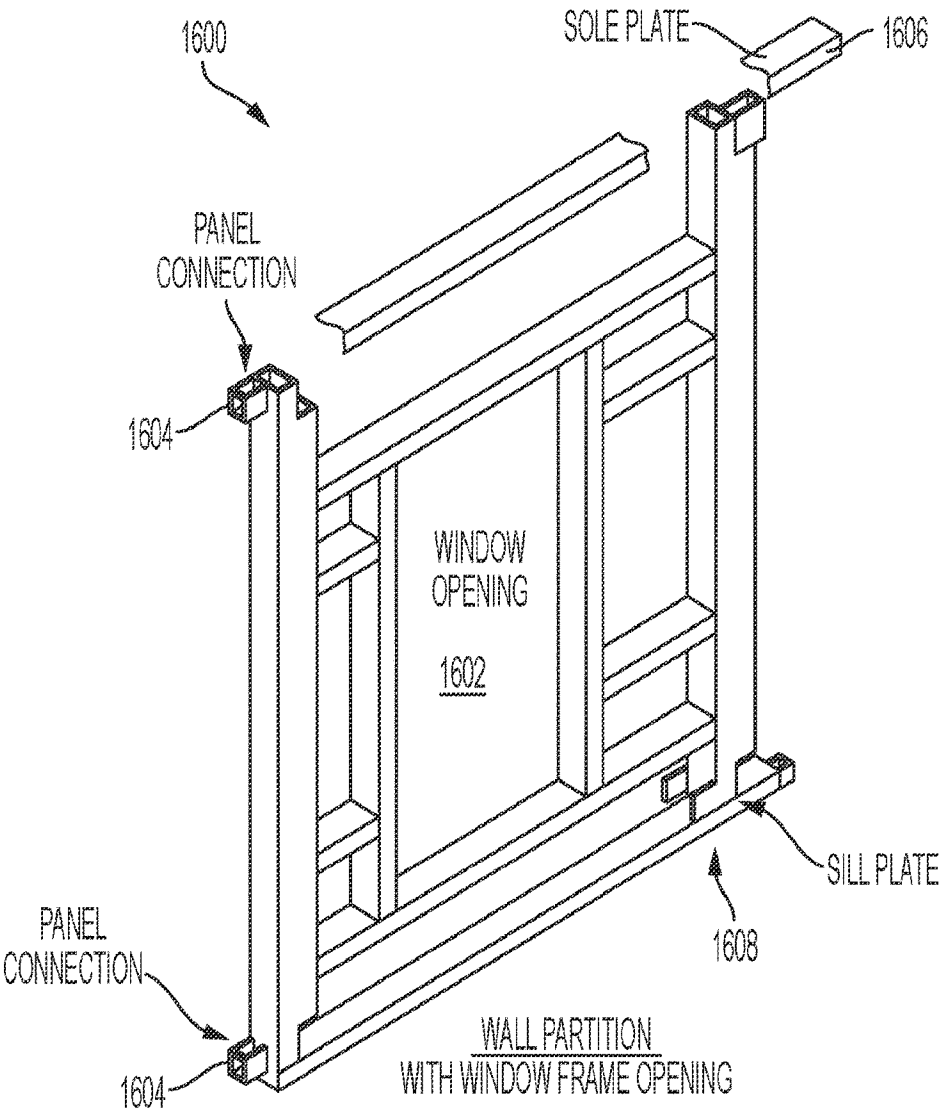
FIG. 16 illustrates a wall partition of the modular reattachable structure system according to an example of the instant disclosure.

FIG. 16 illustrates a wall partition 1600 of the modular reattachable structure system 100 according to an example of the instant disclosure. As shown in FIG. 16, the wall partition 1600 may be provided between a first interior or internal wall 101 and a second interior or internal wall 101. Alternatively, the wall partition may be provided between a first exterior wall 106 and a second exterior wall 106. There may be one or more window frame openings 1602 between the first wall and the second wall. In addition, there may be one or more panel connections 1604 that may be used to attach the first wall to the second wall. There may be a sole plate 1606 at a top and a sill plate 1608 at the bottom.

FIGS. 17A and 17B illustrate a roll of drywall seamer tape 1702 with compound already on one side can be applied with a hard roller device 1704.

Figure 18:
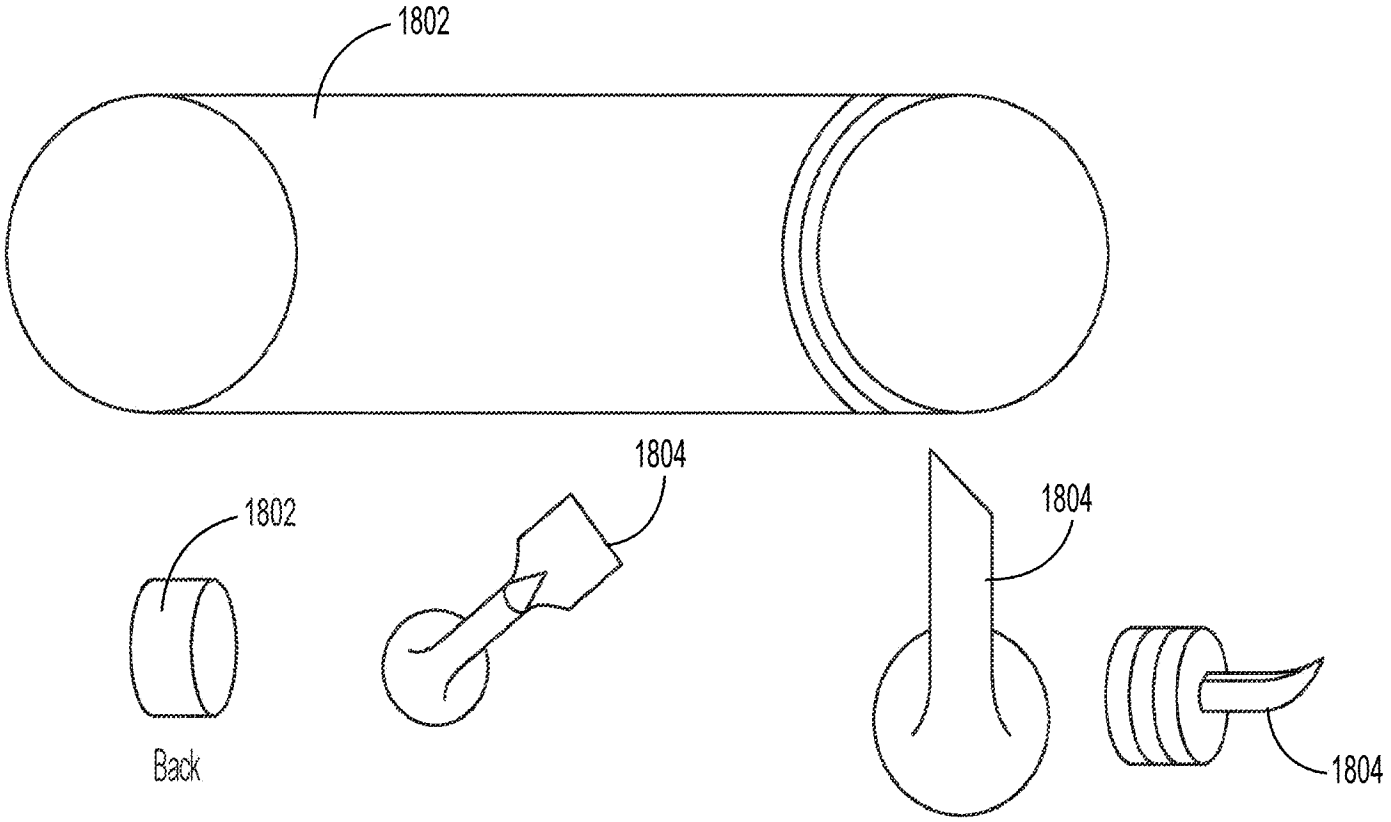
FIG. 18 illustrates a reusable caulking gun according to an example of the instant disclosure.

FIG. 18 illustrates a reusable caulking gun 1802 and tips 1804 for screw finishing compounds, it can be used for any silicone, grout, mortar and joint compound applications. One side of the tube unscrews to wash and refill the tube with any material used in the construction industry and includes the tip where the material exits the system. The other side slides and pressurizes the material to come out of the tip.

Figure 19:
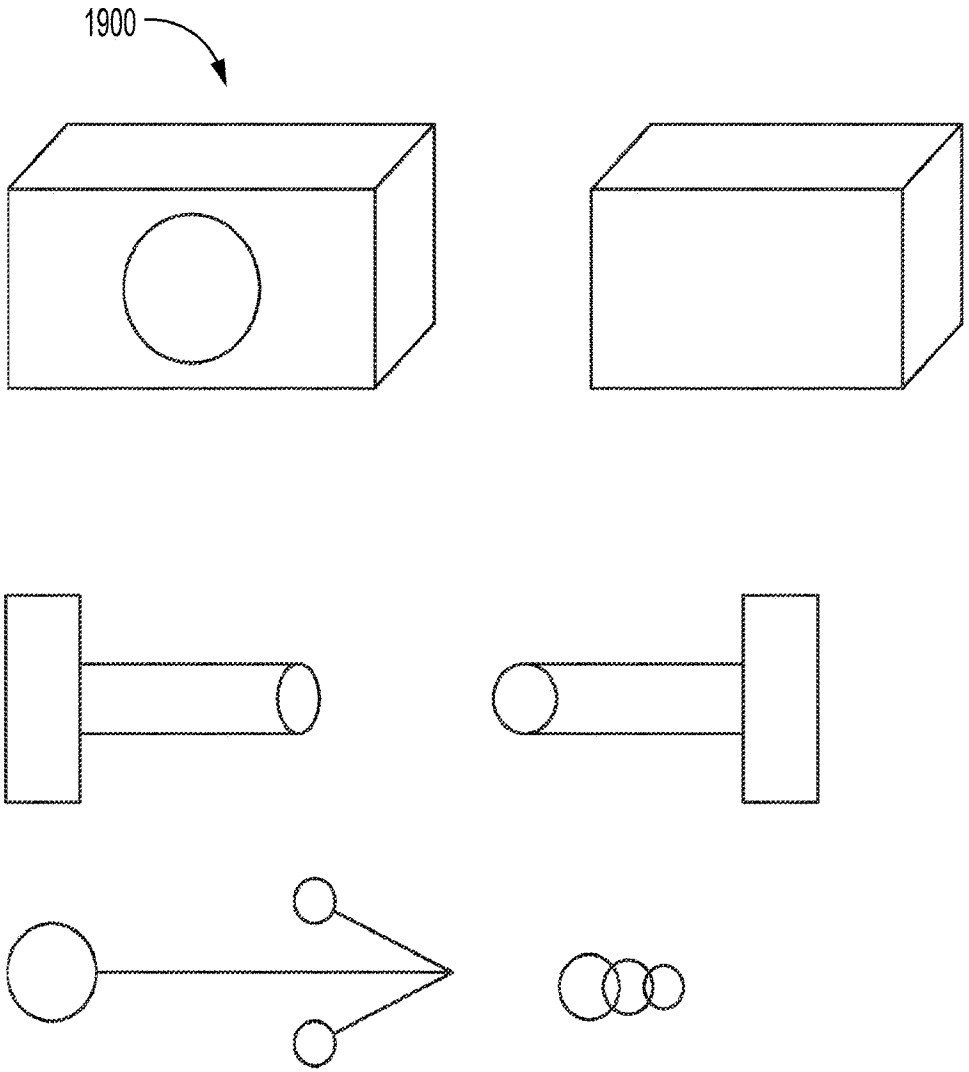
FIG. 19 illustrates a locking mechanism according to an example of the instant disclosure.

FIG. 19 illustrates a locking mechanism 1900 that comes with push button release and push button lock. Unlike other conventional mechanisms, it can utilize a push in to release, and a let go to lock.

Figure 20:
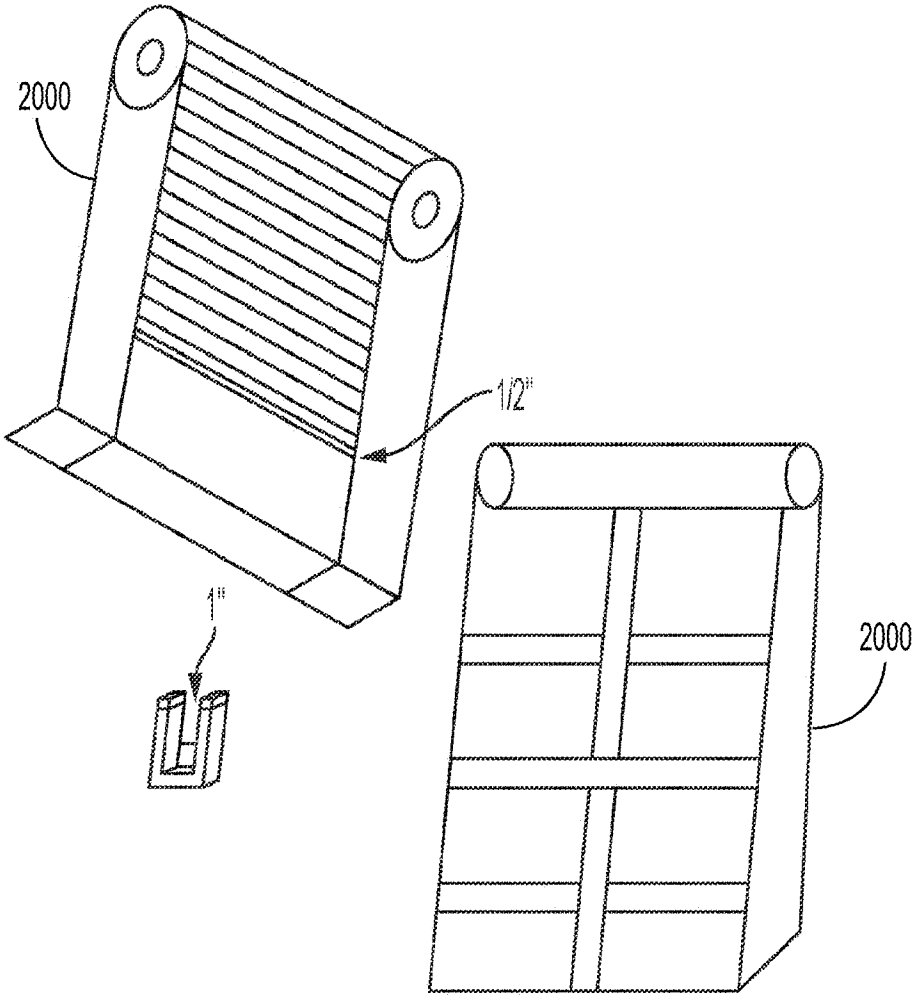
FIG. 20 illustrates windows with wind resistant barriers according to an example of the instant disclosure.

FIG. 20 illustrates windows 2000 with wind resistant barriers already built in with capabilities of electric rolling mechanism to roll up and down creating a high wind resistant shutter.

Figure 21:
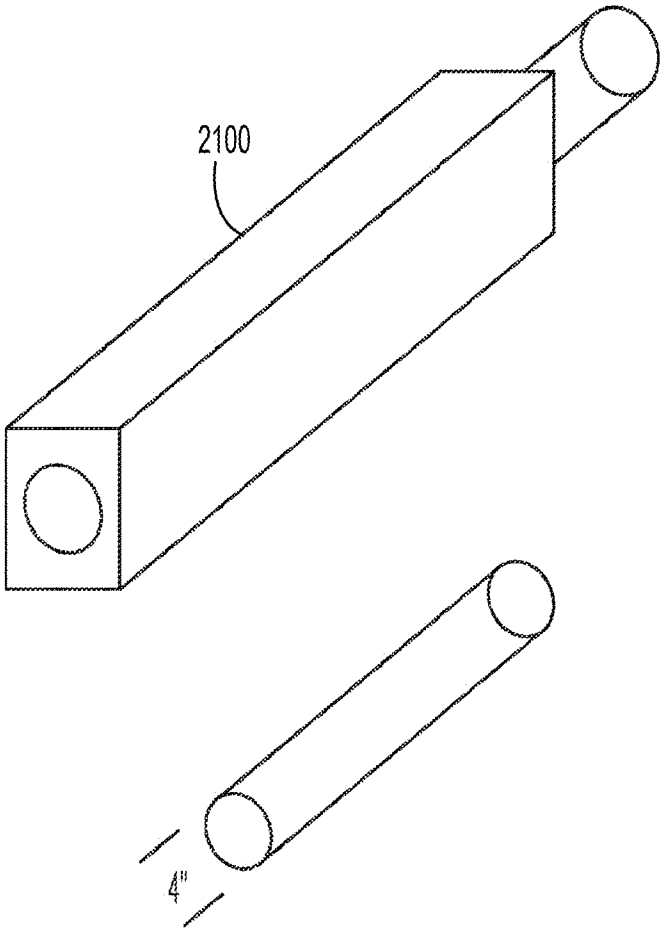
FIG. 21 illustrates metal square tubing according to an example of the instant disclosure.

FIG. 21 illustrates metal square tubing 2100 with PVC inside of foam within the interior of the metal square tubing for soil stack release. If reusable it can be attached with couplings such as FERNCO couplings. For non-reusable applications it can be attached with PVC cleaner and glue couplers.

Figure 22:
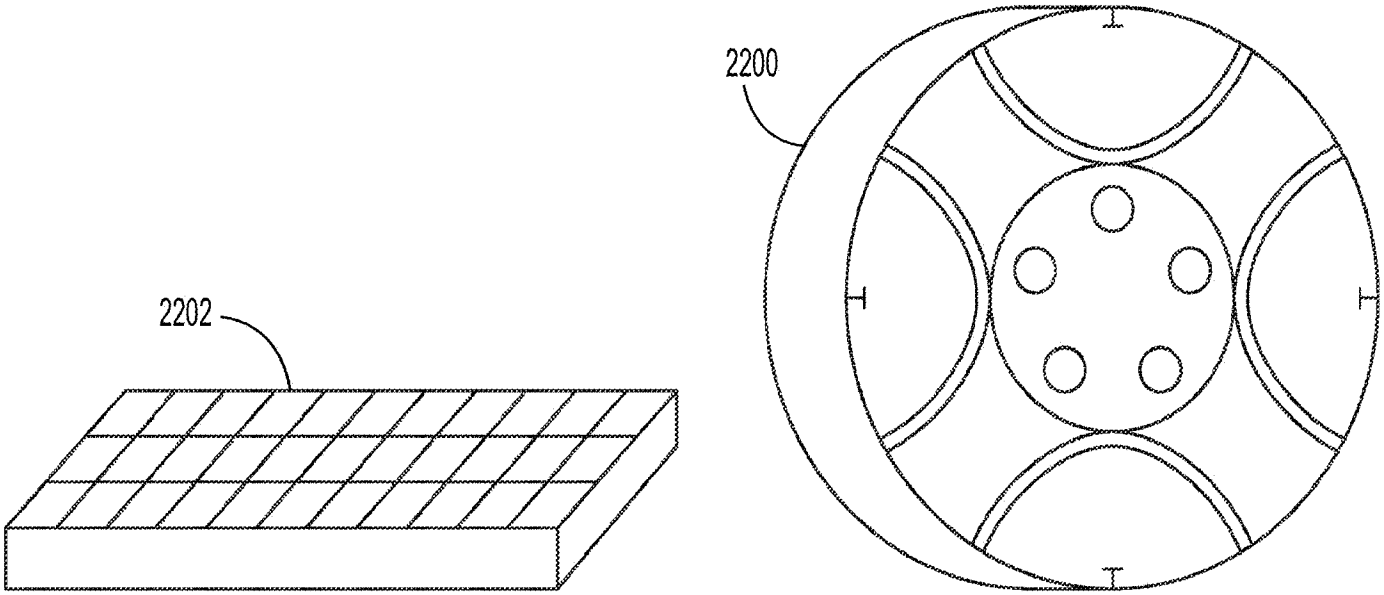
FIG. 22 illustrates a vehicle rim according to an example of the instant disclosure.

FIG. 22 illustrates a vehicle rim 2200 with stability supports in the center of the rim to contain the imperfections of the road and the outside cover is 1" inch rubber and airless that slips on and off to change different treads (e.g., illustrative tread 2202) for different regions.

Figure 23:
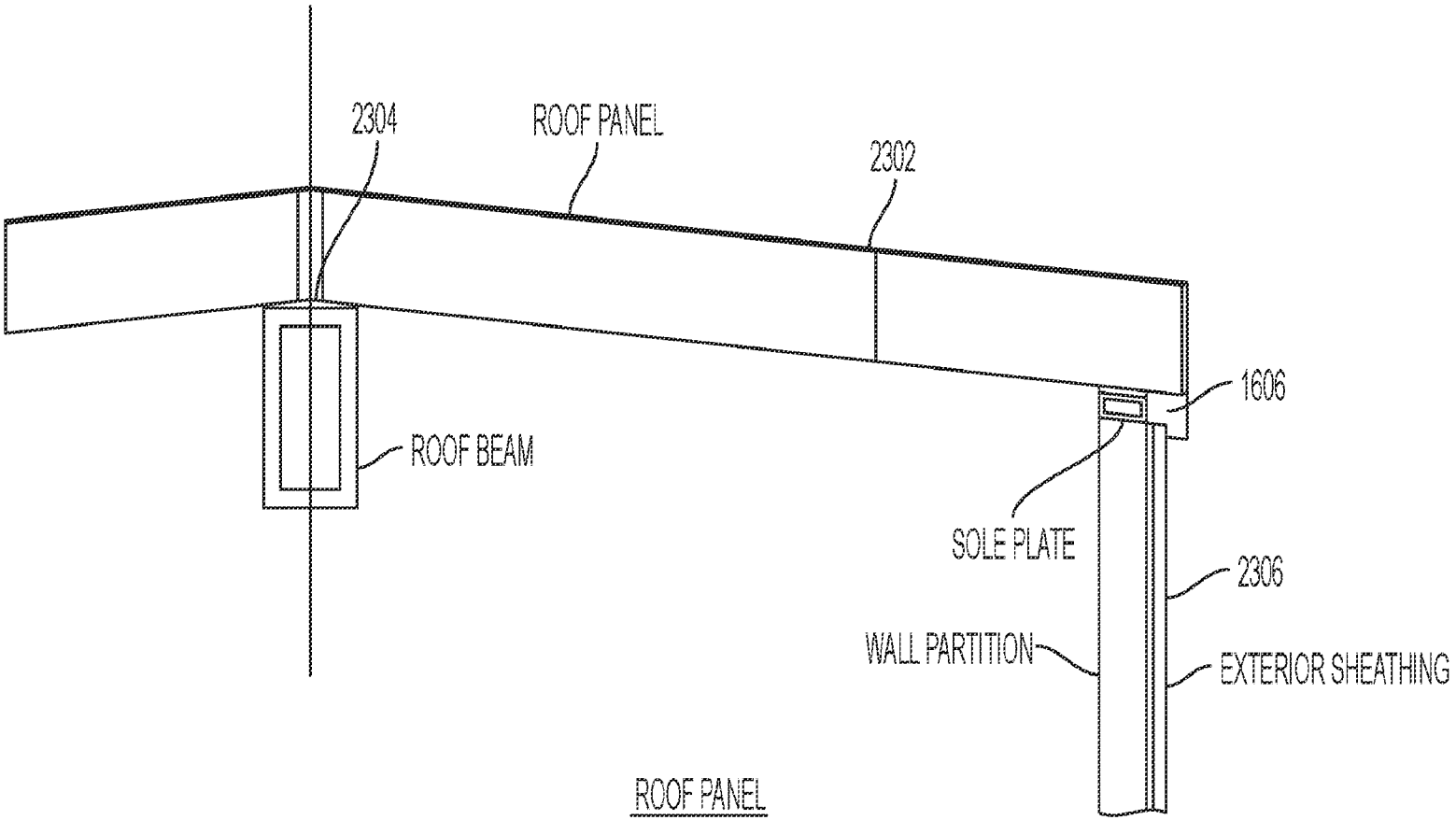
FIG. 23 illustrates a roof panel of the modular reattachable structure system according to an example of the instant disclosure.

FIG. 23 illustrates a roof panel 2302 of the modular reattachable structure system according to an example of the instant disclosure. As shown in FIG. 23, there may be a roof panel 2302 that is supported by a roof beam 2304 and a sole plate 1608. There may be exterior sheathing 2306 that may be on an exterior side of the wall 106. In addition, as is shown in FIG. 23, there may be wall partitions between each wall 106.

Figure 24:
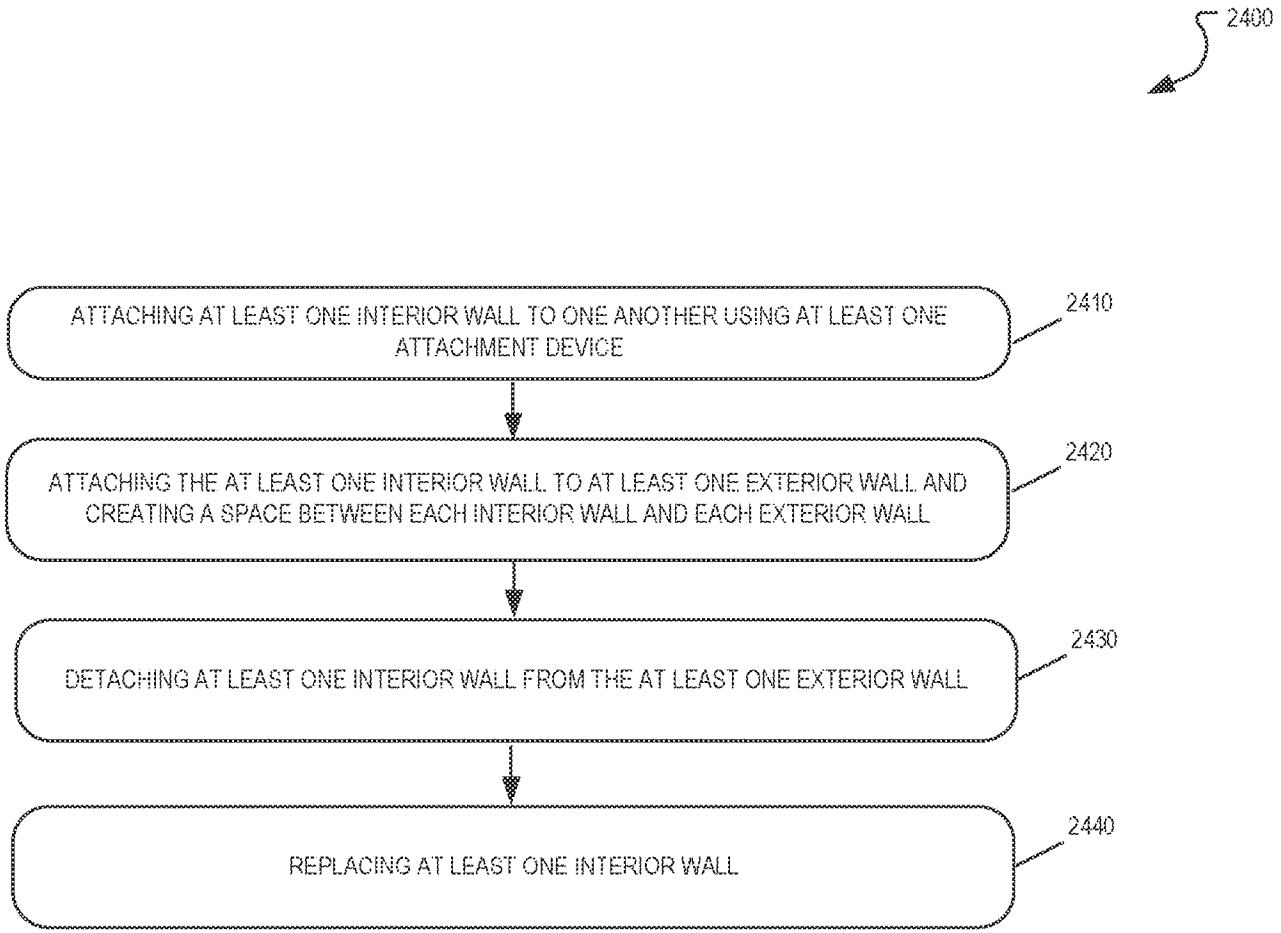
FIG. 24 illustrates an example method of attaching and detaching one or more interior walls of the modular reattachable structure system according to an example of the instant disclosure.

FIG. 24 illustrates an example method 2400 of attaching and detaching one or more interior walls of the modular reattachable structure system 100 according to an example of the instant disclosure. Although the example method 2400 depicts a particular sequence of operations, the sequence may be altered without departing from the scope of the present disclosure. For example, some of the operations depicted may be performed in parallel or in a different sequence that does not materially affect the function of the method 2400. In other examples, different components of an example device or system that implements the method 2400 may perform functions at substantially the same time or in a specific sequence.

According to some examples, the method 2400 includes attaching at least one interior wall to one another to create an internal space between the at least one interior wall at block 2410.

According to some examples, the method 2400 includes attaching a first attachment device incorporated into an exterior face of each interior wall to a second attachment device, the second attachment device incorporated into an interior face of an exterior wall to create a cavity between the exterior face of the interior wall and the interior face of the exterior wall at block 2420.

According to some examples, the method 2400 includes detaching a particular interior wall from the exterior wall in response to a force applied to the particular interior wall at block 2430.

According to some examples, the method 2400 includes replacing the particular interior wall with a new interior wall at block 2440.

The invention is not limited to the particular embodiments illustrated in the drawings and described above in detail. Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application. While the invention has been described with reference to specific illustrative embodiments, modifications and variations of the invention may be constructed without departing from the spirit and scope of the invention as set forth in the following claims.

Illustrative examples of the disclosure include:

Aspect 1: A system comprising: at least one interior wall having a first interior facing side and a second side opposite the interior facing side, at least one exterior wall having a first interior facing side and a second exterior facing side, at least one first attachment device for each interior wall, and at least one second attachment device for each exterior wall, each first attachment device connecting to a respective second attachment device to temporarily attach a respective interior wall to a respective exterior wall and create a cavity between the second side of the interior wall and the first interior facing side of the exterior wall.

Aspect 2: The system of Aspect 1, wherein the at least one exterior wall comprises a structural insulated panel (SIP).

Aspect 3: The system of Aspects 1 and 2, wherein the first interior facing side of each of the at least one interior wall together comprise an interior space within a structure.

Aspect 4: The system of Aspects 1 to 3, wherein the second exterior facing side of each of the at least one exterior wall together create an exterior for a structure.

Aspect 5: The system of Aspects 1 to 4, wherein the first attachment device and the second attachment device comprise a magnet device.

Aspect 6: The system of Aspects 1 to 5, wherein the first attachment device comprises a first wall plate and the second attachment device comprises a second wall plate that connect with one another using polarity.

Aspect 7: The system of Aspects 1 to 6, wherein the at least one interior wall is attached to an inside of a shipping container.

Aspect 8: The system of Aspects 1 to 7, wherein the shipping container comprises a 40 foot×8 foot×9.5 foot high shipping container.

Aspect 9: The system of Aspects 1 to 8, further comprising at least one of light emitting diode (LED) lights, LED screens, and shelving units attached to at least one of the first wall, the second wall, the third wall, and the fourth wall.

Aspect 10: The system of Aspects 1 to 9, further comprising one of an electrical system and a plumbing system that is housed in the cavity between the second side of the interior wall and the first side of the exterior wall.

Aspect 11: The system of Aspects 1 to 10, further comprising one of a flat roof and a hipped roof.

Aspect 12: The system of Aspects 1 to 11, further comprising a foundation concrete block attached to the at least one exterior wall.

Aspect 13: The system of Aspects 1 to 12, wherein the at least one interior wall attach to one another using each first attachment device.

Aspect 14: The system of Aspects 1 to 13, wherein the first attachment device comprises a clip that attaches to another first attachment device.

Aspect 15: The system of Aspects 1 to 14, further comprising a detachment device to detach the least one interior wall from the at least one exterior wall.

Aspect 16: The system of Aspects 1 to 15, further comprising at least one upper part connected to a base of the system comprising (1) a plate having dimensions comprising one of (a) six inches, by six inches, by one inch thick and (b) twelve inches, by six inches, by one inch thick that is attached to a first rod that is tee welded to a concrete stem wall, and (2) two cross bars that are set perpendicular to one another and welded to the first rod, and at least one lower part attached to a respective upper part and comprising: a second rod to be driven into the ground.

Aspect 17: The system of Aspects 1 to 16, wherein the second rod comprises martensitic stainless steel.

Aspect 18: The system of Aspects 1 to 17, comprising six upper parts and six lower parts.

Aspect 19: The system of Aspects 1 to 18, comprising ten upper parts and twelve lower parts.

Aspect 20: The system of Aspects 1 to 19, comprising ten upper parts and twenty-four lower parts.

Aspect 21: A method, comprising: attaching at least one interior wall to one another to create an internal space between the at least one interior wall, attaching a first attachment device incorporated into an exterior face of each interior wall to a second attachment device, the second attachment device incorporated into an interior face of an exterior wall to create a cavity between the exterior face of the interior wall and the interior face of the exterior wall, detaching a particular interior wall from the exterior wall in response to a force applied to the particular interior wall, and replacing the particular interior wall with a new interior wall.

Aspect 22: A system comprising at least one wall having a first interior facing side and a second exterior side opposite the interior facing side, at least one first attachment device for each wall, a shipping container, at least one second attachment device for each wall, each first attachment device connecting to a respective second attachment device to temporarily attach a respective interior wall to the shipping container and create a cavity between the second exterior side and an interior wall of the shipping container, and a ground rod attachment device comprising at least one upper part connected to the shipping container comprising (1) a plate having dimensions comprising one of (a) six inches, by six inches, by one inch thick and (b) twelve inches, by six inches, by one inch thick that is attached to a first rod that is tee welded to a concrete stem wall, and (2) two cross bars that are set perpendicular to one another and welded to the first rod, and at least one lower part attached to a respective upper part and comprising a second rod to be driven into the ground.

Aspect 23: The system of Aspect 20, wherein the shipping container comprises a 40 foot×8 foot×9.5 foot high shipping container.

What is claimed:

1. A foundation plate system for attachment to a structure, comprising:

a ground rod attachment device comprising:

a foundation plate having a top side and a bottom side, the top side of the foundation plate configured to be connected to a base of the structure;

a foundation rod extending downwardly from the bottom side of the foundation plate, the foundation rod extending substantially through a slab supporting the structure;

at least one cross bar coupled to the foundation rod in an orientation normal to the foundation rod;

a ground rod connected at an end of the foundation rod distal from the foundation plate, the ground rod extending downwardly from the foundation rod substantially through a footing located below the slab and into an underlying ground surface;

wherein the foundation rod and the ground rod are a unitary structure of one-piece construction.

2. The system of claim 1, wherein the at least one cross bar comprises first and second cross bars coupled to the foundation rod.

3. The system of claim 1, wherein the at least one cross bar comprises first and second cross bars coupled to the foundation rod, and wherein the second cross bar is coupled to the foundation rod at a depth different than a depth of the first cross bar, and wherein the second cross bar has an orientation normal to an orientation of each of the first cross bar and the foundation rod.

4. The system of claim 1, wherein the at least one cross bar comprises first and second cross bars coupled to the foundation rod, and wherein the second cross bar is coupled to the foundation rod at a depth different than a depth of the first cross bar.

5. The system of claim 4, further comprising a stability bar coupled to the first and second cross bars.

6. The system of claim 5, wherein the stability bar comprises a length of rebar.

7. A foundation connection system for mechanically and electrically attaching a structure to an underlying ground surface, comprising:

a foundation plate coupled to the foundation rod at the upper end of the foundation rod, the foundation plate having a top side and a bottom side, the top side of the foundation plate configured to be connected to a base of the structure;

a foundation rod having an upper end and a lower end, the upper end of the foundation rod extending downwardly from the bottom side of the foundation plate, and the lower end of the foundation rod extending substantially through a slab supporting the structure;

at least one cross bar coupled to the foundation rod at a distance from the upper end and the lower end;

a ground rod securely and electrically attached at the lower end of the foundation rod, the ground rod extending downwardly from the foundation rod substantially through a footing located below the slab and into the underlying ground surface;

wherein the foundation rod and the ground rod are a continuous, unitary structure.

8. The system of claim 7, wherein the ground rod extends about eight feet downwardly into the ground surface.

9. The system of claim 7, wherein the at least one cross bar is coupled to the foundation rod in an orientation normal to the foundation rod.

10. The system of claim 7, wherein the at least one cross bar comprises first and second cross bars coupled to the foundation rod, and wherein the second cross bar is coupled to the foundation rod at a depth different than a depth of the first cross bar.

11. The system of claim 10, further comprising a stability bar coupled to the first and second cross bars.

12. The system of claim 11, wherein the stability bar comprises a length of rebar.

13. The system of claim 7, wherein the at least one cross bar comprises first and second cross bars coupled to the foundation rod, and wherein the second cross bar is coupled to the foundation rod at a depth different than a depth of the first cross bar, and wherein an orientation of the second cross bar is normal to an orientation of the first cross bar and the foundation rod.

14. The system of claim 13, wherein the first and second cross bars have a length of about one inch.

15. The system of claim 13, wherein the first and second cross bars have a length of about four inches.

16. A method of securely mechanically and electrically grounding a structure, comprising the steps of:

driving a ground rod through a footing and into an underlying ground surface;

placing a foundation plate having an upper connecting portion and a foundation rod extending downwardly therefrom above the footing and electrically connecting the foundation rod to the ground rod;

backfilling a slab onto the footing and about the foundation rod to provide a stable foundation for the foundation plate and the structure; and securely mechanically and electrically connecting the structure to the upper portion of the foundation plate.

17. The method of claim 16, wherein the ground rod is driven about eight feet downwardly into the ground surface.

18. The method of claim 16, further comprising the step of securely coupling at least one cross bar to the foundation rod to provide additional structural stability to the structure.

* * * * *